US007967706B2

(12) United States Patent
Cottey et al.

(10) Patent No.: US 7,967,706 B2
(45) Date of Patent: Jun. 28, 2011

(54) RACKET FOR BALL GAMES

(75) Inventors: Rob Cottey, Wolfurt (AT); Johan Kotze, Wolfurt (AT); Stefan Mohr, Wolfurt (AT); Claus Müller, Feldkirch (AT); Klaus Rambach, Peiting (DE); Jürgen Wilke, Wolfurt (AT); Manfred Emberger, Lochau (AT); Harald Rosenkranz, Lauterach (AT)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 12/278,236

(22) PCT Filed: Feb. 1, 2007

(86) PCT No.: PCT/EP2007/000929

§ 371 (c)(1),
(2), (4) Date: Jun. 26, 2009

(87) PCT Pub. No.: WO2007/088070

PCT Pub. Date: Aug. 9, 2007

(65) Prior Publication Data

US 2010/0048333 A1 Feb. 25, 2010

(30) Foreign Application Priority Data

Feb. 2, 2006 (DE) ..... 10 2006 004 849
Feb. 2, 2006 (DE) ..... 10 2006 004 863

(51) Int. Cl.
*A63B 49/02* (2006.01)

(52) U.S. Cl. ..... 473/521; 473/537; 473/546; 473/548

(58) Field of Classification Search ..... 473/520, 473/521, 524, 537, 546, 548
See application file for complete search history.

(56) References Cited

U.S. PATENT DOCUMENTS 4,139,194 A * 2/1979 Fischer ..... 473/521
4,353,551 A 10/1982 Arieh et al.
5,082,266 A 1/1992 Lo (Continued)

FOREIGN PATENT DOCUMENTS

DE 41 02 901 A1 8/1992

(Continued)

OTHER PUBLICATIONS

International Search Report for PCT/EP2007/000929, dated Dec. 10, 2007.

(Continued)

*Primary Examiner* — Raleigh W. Chiu
(74) *Attorney, Agent, or Firm* — Finnegan, Henderson, Farabow, Garrett & Dunner LLP

(57) ABSTRACT

A racket for ball games may include a frame which is formed by a frame profile or a hollow profile and has a racket head and a handle portion connected thereto preferably via a heart region. Two indentations that are symmetrical relative to the longitudinal axis of the racket may be provided in the heart region of the frame. A vibrating device may be arranged in each of the two indentations. The vibrating means of the racket may preferably be effective for vibrations having at least two vibration modes or degrees of freedom. Additionally or alternatively, a racket for ball games may include a frame which forms a head region for receiving strings and a handle portion for holding the racket. The frame may include one respective inwardly-facing C-profile in at least two segments of the head region.

36 Claims, 13 Drawing Sheets

U.S. PATENT DOCUMENTS

| | | | | |
|---|---|---|---|---|
| 5,362,046 | A | 11/1994 | Sims | |
| 5,651,545 | A | 7/1997 | Nashif et al. | |
| 6,293,878 | B1 * | 9/2001 | Iwatsubo et al. | 473/521 |
| 6,575,854 | B1 | 6/2003 | Yang et al. | |
| 6,623,383 | B2 * | 9/2003 | Matsuoka et al. | 473/519 |
| 6,623,384 | B2 * | 9/2003 | Kanemitsu | 473/521 |
| 6,840,874 | B2 * | 1/2005 | Severa et al. | 473/521 |
| 6,966,855 | B2 * | 11/2005 | Yu | 473/521 |
| 7,070,525 | B2 | 7/2006 | Wilke et al. | |
| 7,081,055 | B2 * | 7/2006 | Hsu | 473/521 |
| 2002/0058557 | A1 | 5/2002 | Kanemitsu | |
| 2005/0003911 | A1 * | 1/2005 | Yu | 473/521 |
| 2005/0197218 | A1 * | 9/2005 | Mauser et al. | 473/520 |
| 2006/0079353 | A1 * | 4/2006 | Hsu | 473/520 |
| 2010/0048333 | A1 * | 2/2010 | Cottey et al. | 473/521 |

FOREIGN PATENT DOCUMENTS

| | | | |
|---|---|---|---|
| DE | 195 24 095 | A1 | 1/1997 |
| DE | 195 31 642 | A1 | 3/1997 |
| DE | 195 37 062 | A1 | 4/1997 |
| DE | 196 14 247 | C1 | 7/1997 |
| DE | 200 22 506 | U1 | 1/2002 |
| DE | 201 20 766 | U1 | 3/2002 |
| DE | 100 60 457 | A1 | 4/2002 |
| DE | 103 04 797 | A1 | 8/2004 |
| DE | 103 08 532 | B3 | 10/2004 |
| DE | 10 2004 003 528 | B3 | 7/2005 |
| DE | 10 2004 003 526 | B3 | 9/2005 |
| EP | 0 104 930 | A1 | 4/1984 |
| EP | 0 461 561 | A1 | 12/1991 |
| EP | 0 550 121 | A1 | 7/1993 |
| EP | 0 898 986 | A2 | 3/1999 |
| EP | 1 060 767 | A2 | 12/2000 |
| WO | WO 88/01890 | | 3/1988 |

OTHER PUBLICATIONS

Translation of International Preliminary Report on Patentability for PCT/EP2007/000929, dated Sep. 9, 2008.

* cited by examiner

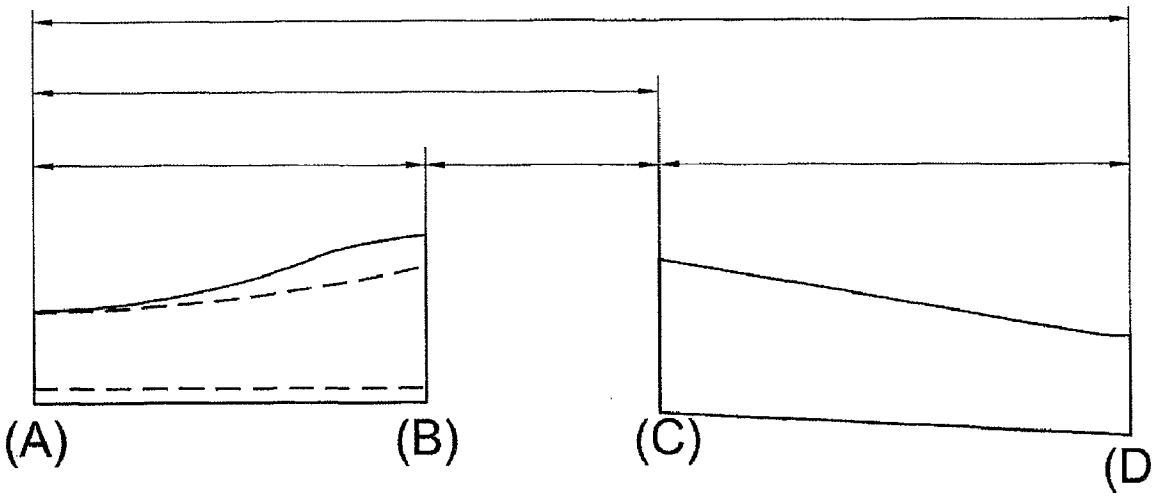
Fig. 11f
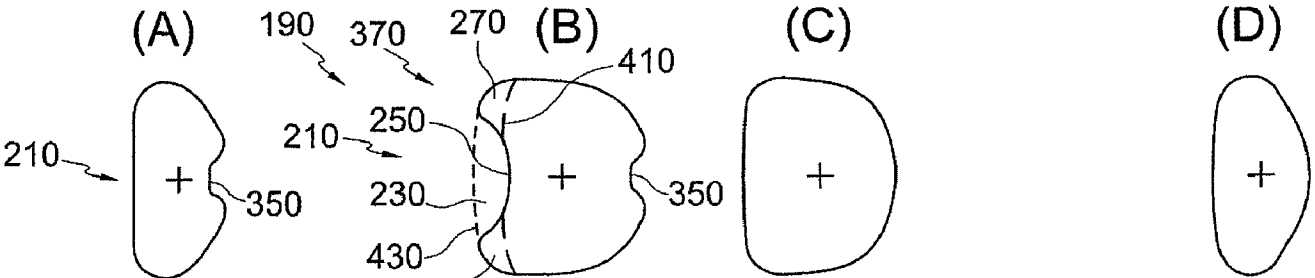
Fig. 11a Fig. 11b Fig. 11c Fig. 11d Fig. 11e
Fig. 11

Fig. 12a
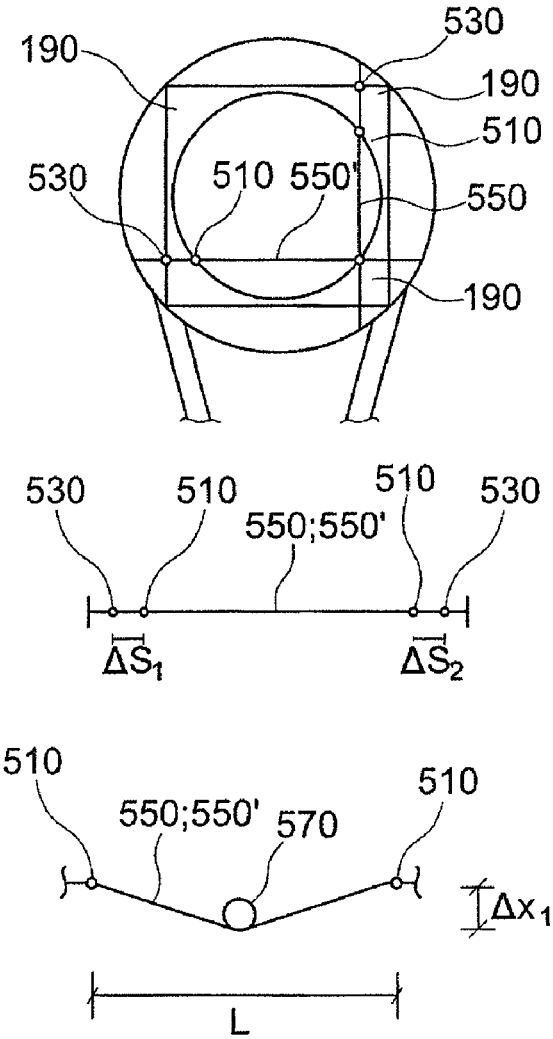
Fig. 12b
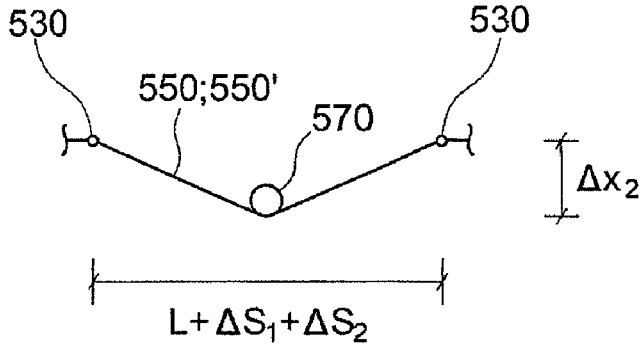
Fig. 12

RACKET FOR BALL GAMES

The present invention relates to a racket for ball games, in particular a tennis racket, squash racket, badminton racket, racquet ball racket or paddle tennis racket having excellent handling properties.

Rackets of this kind typically have a frame forming a racket head and a handle portion connected thereto. A so-called heart region is typically formed in the transition area between the racket head and the handle portion. The frame is usually formed by a frame profile which is often produced of a carbon fiber reinforced plastics material in a molding press. The racket head of the racket defines a stringing plane in which the stringing of the racket is arranged. For receiving the individual strings of the stringing, through holes through which the individual strings can be passed are provided at the frame in the stringing plane.

Moreover, it is known to provide damping means on the racket. For example, U.S. Pat. No. 5,651,545 discloses a vibration damping device for stringed rackets including a viscoelastic member adapted to be mounted between the strings of the racket and at least one movable member carried on the viscoelastic member. The movable member is movable relative to the viscoelastic member in response to a ball's impact on the strings of the racket such that the vibration damping device vibrates over the same frequency range but out of phase with the racket to dampen vibrations in the racket.

A further damper is described, for example, in US 2002/0058557 A1. This damper has a viscoelastic part and a mass-adding part laminated on the viscoelastic part. The damper has a horizontal frame and a vertical frame disposed at both sides of the horizontal frame in the shape of a lattice. In this structure, the horizontal frame and the vertical frame are integrally formed or formed by connecting the horizontal frame and the vertical frame with one another, the horizontal frame being provided at at least one surface of the racket in a thickness direction and the vertical frame being provided at both sides of the racket in a width direction.

Furthermore, U.S. Pat. No. 4,353,551 discloses a tennis racket in which dynamic weights are distributed symmetrically relative to the longitudinal axis of the racket between the heart region and the transverse axis of the racket head. The weights are displaceable in a direction perpendicular to the stringing plane. The weights are suspended by elastic straps whose respective ends are glued to the front and rear surfaces of the racket frame. The weights are arranged outside the striking surface. In accordance with another embodiment, the weights are mounted on a mounting plate by means of respective helical springs, wherein the racket frame is provided with through holes in which the weights are guided in a direction perpendicular to the stringing plane of the racket. The frequency of the damper is adapted to a vibration frequency of about 1.4 to 2 times the basic natural vibration frequency of the racket.

Moreover, for example EP 0 898 986 B1 discloses a device for damping vibrations of a ball racket in which a damper weight is fixed on or in the handle-side end of the ball racket in a manner capable of elastically excursing from the handle axis. The damper weight is selected to be 0.6 to 3.5% of the weight of the stringed racket. The elastic fixation is adjusted or dimensioned to at least a one-axis deflection at an intrinsic frequency of between 100 and 300 Hz. The damper weight is arranged in a hollow space at the end of the handle in an elastic carrier which is supported at the wall of the hollow space at at least two areas that are diametrically opposite to one another with respect to the handle axis.

DE 103 04 797 A1 discloses a ball game racket comprising a racket frame forming a racket head for a stringing as well as a racket shank projecting from the racket head and having a racket handle, the racket frame comprising at a frame element between the racket head and the racket handle at least one area having a reduced torsional stiffness without impairing the flexural strength of the racket in a plane including the longitudinal extension of the frame element and extending perpendicular with respect to the stringing plane. At least one damping material, for example an elastomeric material, which should have a damping effect upon deformation is provided at the at least one area having a reduced torsional stiffness.

Further ball game rackets, some comprising damping means, are known from U.S. Pat. No. 5,362,046, DE 196 14 247 C1, DE 100 60 457 A1, DE 195 37 062 A1, DE 195 31 642 A1, DE 201 20 766 U1 and WO-A-88/01890. Furthermore, specific racket frame designs of a ball game racket are known, e.g., from EP 1 060 767 A2, U.S. Pat. No. 5,082,266 and DE 103 08 532 B3.

It is the object of the present invention to provide an improved racket allowing an excellent damping effect and ball acceleration. This object is achieved with a racket comprising the features of the independent claims. The dependent claims describe preferred embodiments of the racket according to the present invention.

The racket for ball games according to the present invention comprises a frame formed by a frame profile or hollow profile and having a racket head and a handle portion connected thereto preferably via a heart region. The racket head defines a stringing plane. Two indentations that are symmetrical with respect to the longitudinal axis of the racket are provided in the heart region of the frame. The indentations extend in a direction parallel with respect to the stringing plane and towards one another, i.e. they are open on outer sides of the frame that face away from one another. The indentations at least partially reduce the width of the racket or frame in this area. The indentations can also be realized by an outwardly extending C-profile of the frame, i.e. they can have side walls (in the X-Y direction parallel to the stringing plane). A vibrating means is arranged in each of the two indentations. The vibrating means arranged in the racket according to the present invention are preferably effective for vibrations having at least two vibration modes or degrees of freedom, i.e. vibrations in at least two different axial directions.

In accordance with another aspect of the present invention, two vibrating means are arranged at the frame in the heart region symmetrically with respect to the longitudinal axis of the racket. These vibrating means are effective for vibrations having at least two vibration modes or degrees of freedom, i.e. vibrations in at least two different axial directions, and their longitudinal direction preferably extends in the direction of the frame at their attachment point. The heart region of the frame comprises preferably two indentations which are provided symmetrically with respect to the longitudinal axis of the racket and in each of which one of the vibrating means is arranged.

In the racket of the present invention, each of the vibrating means is preferably attached in two sites of the frame that are spaced from each other along the frame in the circumferential direction or longitudinal direction of the racket, preferably at its outer side, for example in an indentation or recess provided therein. The vibrating means preferably comprises a mass part which is fixed at the frame by at least one viscoelastic element or spring element. The mass part is preferably formed of metal, e.g. steel, iron or non-ferrous metals such as brass, lead, tungsten, titanium or alloys thereof. It is also possible to use carbon fiber composite materials and other materials that are deflection resistant in case of the dimensions of the present invention. This mass part preferably has an elongate shape and is, e.g., about 10 mm to 70 mm, preferably about 35 to 55 mm, particularly preferably about 40 to 50 mm long. The width of the mass part preferably ranges between about 2 mm and 20 mm, preferably about 4 mm to 10 mm, particularly preferably is about 6 mm. The ratio between length and width is preferably about 2:1 to 15:1, particularly preferably about 3:1 to 10:1 or about 4:1 to 8:1. The thickness of the mass part is about 0.5 mm to 5 mm, more preferably about 0.8 to 3 mm, particularly preferably about 1.5 to 2 mm. Preferably, the mass part is slightly bent about an axis extending in the longitudinal direction in order to increase stability. The mass part of each vibrating means typically has a mass of less than 35 g, preferably a mass in the range of 1 g to 30 g, more preferably 2 g to 20 g, most preferably 2.5 g to 10 g. The mass $m_s$ of the racket (without vibrating means) is typically about 200 g to 300 g.

The viscoelastic material or spring element is preferably formed of an elastomeric material, such as rubber, caoutchouc, e.g. natural rubber (NR), acrylonitrile butadiene rubber (NBR), polychloroprene rubber (CR), neoprene, of a thermoplastic material or a thermoplastic elastomer or of a flexible foam, such as polyurethane (PUR), or TPUR. For example, the elastomeric material can be a silicone rubber. In principle, all materials having suitable resiliency or elasticity characteristics can be used for the spring element. In particular, materials having a modulus of elasticity ranging between 1 $N/mm^2$ to 1000 $N/mm^2$, preferably 50 $N/mm^2$ to 200 $N/mm^2$, and/or densities preferably ranging between 0.2 $g/cm^3$ to 3 $g/cm^3$ and most preferably between 0.4 $g/cm^3$ to 1.8 $g/cm^3$ are suitable. The mass of the spring element typically lies between 1 g and 20 g, preferably between 3 g and 10 g, particularly preferably between 5 g and 8 g.

Moreover, the ratio between the mass of the mass part and the mass of the spring element of a vibrating means preferably lies in the range of 1:10 to 10:1, preferably in the range of 1:5 to 5:1 or 1:2 to 2:1. Moreover, the ratio of the mass of the two vibrating means, i.e. both spring elements and both mass parts, relative to the overall mass of the racket (without the two vibrating means) preferably lies in the range of 1:30 to 1:4, preferably in the range of 1:20 to 1:10.

Preferably, the vibrating means and the corresponding indentation are shaped such that the frame has an essentially continuously extending outer circumferential surface. To this end, the vibrating means preferably comprises a first mounting portion and a second mounting portion at the two ends of the indentation as well as a bridging portion connecting the two mounting portions. The bridging portion bridges the opening of the indentation and generally extends in the direction of the frame at the respective site. The two mounting portions serve for fixing the vibrating means at opposite places within the indentation. To this end, the first and second mounting portions are both shaped in accordance with the curvature of the indentation of the frame. The vibrating means is preferably glued to the frame or put on the frame in a form-fit manner or by clamping, or it is held by a form-fit or frictional connection by the string band of the racket, wherein it is also possible to combine these ways of mounting, e.g. gluing and form-fit connection. Preferably, the two mounting portions as well as the bridging portion form together the spring element of the vibrating means. The mass part is preferably embedded in the bridging portion. Instead of providing only one mass part, it is also possible to provide a plurality of separate or coupled mass parts in the spring element. Alternatively, the mass part(s) form(s) the bridging portion. To this end, the mounting portions preferably have fixing or bridging head portions for being connected or coupled with the mass part.

The vibrating means is preferably effective for vibrations having several, e.g. two or four and up to six vibration modes or degrees of freedom, wherein the coordinate system is preferably selected such for describing the vibrations that the X-direction extends in the longitudinal direction of the vibrating means, the Y-direction perpendicular with respect thereto in the stringing plane, and the Z-direction perpendicular with respect to the stringing plane. A vibration having a first vibration mode or degree of freedom is, e.g., in a vibrating or axial direction essentially perpendicular with respect to the stringing plane of the racket. In the following, this direction is referred to as Z-direction. The frequency of the vibrations in this direction is called frequency $f_1$. A vibration having a second degree of freedom is, e.g., in a vibrating or axial direction essentially in the longitudinal direction of the vibrating means and, therefore, in the direction of the racket frame where the vibrating means is arranged. In the following, this direction is referred to as X-direction. The frequency of the vibrations in this direction is called frequency $f_2$. A vibration having a third degree of freedom is, e.g., in a vibrating or axial direction essentially transversely or perpendicular with respect to the longitudinal direction of the vibrating means in the stringing plane of the racket. In the following, this direction is referred to as Y-direction. The frequency of the vibrations in this direction is called frequency $f_3$. The fourth, fifth and sixth degrees of freedom are defined by rotational vibrations about the Z-, X- and Y-axes, respectively. Accordingly, a vibration having a fourth degree of freedom is, e.g., a rotational vibration of the vibrating means about an axis in the Y-direction. Such a vibration can be called "pitching" relative to the longitudinal direction of the vibrating means. The frequency of this vibration is called frequency $f_4$. A vibration having a fifth degree of freedom is, e.g., a rotational vibration about an axis in the Z-direction. Such a vibration is also referred to as "yawing". The frequency of this rotational vibration about an axis in the Z-direction is called frequency $f_5$. A vibration having a sixth degree of freedom is, e.g., a rotational vibration about an axis in the X-direction. Such a rotational vibration can also be called "rolling". The frequency of this rotational vibration is called frequency $f_6$.

The vibrating means is preferably effective at vibrations in directions of the respective degrees of freedom or vibration modes at different frequencies, i.e. has different intrinsic frequencies. Thus, a vibrating means that has a wide-band damping frequency spectrum and can be used for damping the intrinsic vibrations of the racket is provided. Preferably, the vibrating means is tuned at least in the direction of a degree of freedom to a frequency that essentially corresponds to 0.8 times to 1.2 times the vibration frequency of the racket $f_{racket}$. Particularly preferably, in at least one vibration mode or in the direction of one degree of freedom, the vibrating means is adjusted to a frequency which essentially corresponds to the vibration frequency of the racket $f_{racket}$. This degree of freedom is, e.g., the vibration at frequency $f_1$ perpendicular with respect to the stringing plane. At this frequency the vibration of the racket is damped particularly effectively. Alternatively thereto or preferably in combination with such a tuning, the vibrating means is tuned at least in the direction of another degree of freedom to a frequency corresponding essentially to 1.3 times to 3 times, preferably about 1.5 times to 2.5 times, particularly preferably about 2 times the vibration frequency of the racket $f_{racket}$. This leads to an increase in the striking power of the racket because the vibrating element vibrates approximately "in phase" with the racket when the ball leaves the striking surface.

Hence, in accordance with the present invention, the vibrating means can have a damping effect for the intrinsic or natural vibrations of the racket at some or all of the frequencies $f_1$ to $f_6$. This allows a wide-band damping spectrum, similar to that of a broad-band filter, and damping can be more effective because vibration energy can be absorbed at different vibration frequencies. Moreover, however, it is also possible to adjust the frequencies $f_1$ to $f_6$ such that some of the frequencies have a damping effect and other frequencies cause an increase in the striking force of the racket.

By the specific design of the vibrating means, the frequencies $f_1$ to $f_6$ can be adjusted to desired frequencies. Hence, a frequency tuning or also frequency matching or frequency adaptation is possible. To this end, e.g., the mass, the material, the geometry and/or the mass ratios of the mass part and/or spring element can be varied. For example, when changing the width or thickness of the mass part, the vibration frequency $f_1$ in the Z direction (perpendicular with respect to the stringing plane) can be greater than the frequency $f_3$ in the Y direction (in the stringing plane) or vice versa.

An even more wide-band damping spectrum can be realized in that the two vibrating means have different vibration characteristics. This can be realized, e.g., by different mass parts in the respective vibrating means.

A further racket for ball games according to the present invention comprises a frame which is made of a frame profile or hollow profile and comprises at its head region in at least two segments one respective C-profile that opens inwardly, i.e. towards the stringing.

In this connection, C-profile means a cross-sectional profile that is essentially C-, U- or V-shaped, i.e. has roughly the shape of half a ring. In other words, the profile has a base side and two legs, wings or flanks. Such a C-shaped profile or C-profile is formed, e.g., by a groove or recess extending along the inner side of the frame contour. Such a C-shaped profile or C-profile is formed, e.g., by two legs projecting relative to a base surface, wherein the base surface forms a web or bar in which the openings for the strings are realized.

Inwardly oriented or open towards the inside means in this connection that the C-profile lies in the stringing plane defined by the head region in such a manner that it opens towards the stringing. Here, the stringing extends in particular into the C-profile so that the legs of the C-profile, or its ends, project from the stringing on opposite sides, i.e. extend above and below the stringing, preferably essentially parallel to the stringing plane.

In accordance with this embodiment, the side regions or legs of the inner side of the frame are raised relative to their normal course or relative to the inner region of the inner side of the frame and extend into the interior of the racket, i.e. over the stringing. The inner region of the inner side of the frame preferably essentially maintains its original or normal or unhindered, e.g., oval course. In contrast thereto, the side regions of flanks of the inner side of the frame are clearly raised inwardly relative to their normal course. A perpendicular, top view of the stringing plane of the racket shows an increase in the frame width in the respective segments, which is due to the inwardly opening C-shaped contour of the frame profile in these portions. By the inwardly projecting side regions or flanks of the frame, additional material that has a maximum distance from the neutral fiber is provided in the respective area of the frame so that the flexural strength of the frame can be increased.

According to a further embodiment of the present invention, the C-shaped profile is formed in that the inner region or web of the C-profile of the inner side of the frame that extends essentially perpendicular with respect to the stringing plane is backwardly offset outwardly relative to its normal course, i.e. towards the outer side of the frame relative to the side regions.

In other words, according to this preferred embodiment, the C-profile is formed by providing a groove in the inner side of the frame in the respective segments in the head region. In a view transversely, i.e. perpendicularly with respect to the stringing plane, the groove is preferably arranged approximately in the center of the inner side of the frame profile. It is possible that in a top view of the stringing plane, the contour of the frame is not changed so that the racket of the present invention seems to have a common frame profile at first sight.

In accordance with a further preferred embodiment of the present invention, the C-profile is formed in that the side regions of the inner side of the frame, or the legs of the C-profile, extend inwardly relative to their normal course and relative to an inner region of the frame side or web of the C-profile as well as in that the inner region of the frame side is backwardly offset relative to its normal course outwardly and relative to the side regions of the frame side.

The shape of the head of the racket is to a large extent arbitrary and can be, e.g., oval, egg-shaped, drop-shaped, rectangular with rounded corners, etc. For defining the respective position of the C-profile along the circumference of the racket head, a clock face is normally used, the 12 o'clock position being arranged at the outermost, i.e. free end of the racket head. The 3 o'clock and 9 o'clock positions accordingly lie approximately in the region of the middle of the overall length of the racket head.

Preferably, the at least two segments comprising a C-profile are arranged such at the racket head that a first segment is provided between about 12.30 and 2.30 o'clock, preferably between 1 and 2 o'clock and in particular at about 1.30 o'clock and a further segment between about 9.30 and 11.30 o'clock, preferably between about 10 and 11 o'clock and in particular at about 10.30 o'clock. In a further preferred embodiment, the segments are arranged such at the racket head that a first segment is provided between about 3.30 and 5.30 o'clock, preferably between about 4 and 5 o'clock and in particular at about 4.30 o'clock and a further segment between about 6.30 and 8.30 o'clock, preferably between about 7 and 8 o'clock and in particular at about 7.30 o'clock.

In accordance with a further preferred embodiment of the present invention, four segments are arranged at the racket head, wherein one respective segment is arranged in each of the regions described above.

For defining the respective position of the segments or the C-profile along the circumference of the racket head, normally the angle of a tangent touching the outer circumference of the racket head can still be used, wherein the tangent extending parallel with respect to the racket axis on the side of the racket head is called 0°-tangent and the horizontal tangent extending perpendicular with respect to the longitudinal axis of the racket on the upper side of the racket head is called 90°-tangent (see FIG. 7).

In accordance with this definition, the segments or portions having a C-profile preferably lie approximately in the area of the two upper 45°-tangents and/or approximately in the area of the two lower 45°-tangents.

The racket is preferably formed symmetrically with respect to the longitudinal axis, wherein also the segments or portions having a C-profile, which are opposite to one another in view of the longitudinal axis of the racket, are formed symmetrically. Preferably, the segments or portions having a C-profile are arranged at the frame portions at which the maximum torsional load is expected during use of the racket.

The reduction in the cross-section of the frame, which is caused by a C-profile, i.e. an inner side of the frame that is offset backwardly or outwardly relative to its normal course, is preferably dimensioned such that the frame width (in the direction parallel to the stringing plane and transversely or perpendicularly to the frame) is about 45 to 95%, preferably 50 to 80%, more preferably about 60 to 70% and even more preferably about 65% of the width of the corresponding frame profile without C-shape. In this connection, transversely or perpendicularly with respect to the frame means approximately perpendicular with respect to a longitudinal axis extending through the frame or through individual frame portions or infinitesimal frame elements. Figuratively speaking, such a longitudinal axis approximately follows the frame contour.

In the preferred embodiment of the present invention in which side regions extend inwardly relative to their normal course and project relative to an inner region, the increase in the cross-section of the frame profile is preferably dimensioned such that the frame width (in the direction parallel to the stringing plane and transversely or perpendicularly with respect to the frame) is about 105 to 140%, more preferably 110 to 140% and even more preferably about 120% to 140% of the width of the corresponding frame profile without C-profile.

The length along the frame along which the frame is formed as a C-profile preferably ranges between about 10 mm and about 150 mm, more preferably between about 30 mm and about 100 mm, more preferably between about 50 mm and about 75 mm.

The C-shaped profile is preferably designed such that the width of the cavity or trough formed between the legs of the C, i.e. the distance between the legs of the C-profile, is about 30% to about 90% of the respective overall width of the frame in the corresponding area, preferably about 40% to about 80% and particularly preferably about 60% to about 70%.

Preferably, the bottom of the cavity or trough of the C-profile, i.e. the web at the inner region of the inner side of the frame, is convex, straight or concave. Preferably, the inner region of the inner side of the frame, i.e. the cavity of the C-profile, extends uninterruptedly into the side regions of the inner side of the frame, i.e. the legs of the C-profile, the transition being formed by one or more, optionally changing radiuses.

A view of the cross-section of the frame profile shows that the cavity of the C-profile preferably has a cross-section having essentially the shape of an arc of a circle and a radius of, e.g., about 5 to 25 mm, more preferably about 10 mm. However, the cavity or trough can also be elliptic, hyperbolic, polygonal or rectangular with rounded corners.

The C-profile preferably has a cross-section that varies along the frame. Preferably, the C-profile is gradually formed, i.e. starting from a minimum cavity depth, i.e. a minimum leg length of the side regions, to a maximum cavity depth, i.e. a maximum leg length. Preferably, the C-profile has its maximum cavity depth, i.e. the maximum leg length, approximately in the center relative to the length of the C-profile along the frame. In accordance with a further preferred embodiment, the C-profile has its maximum cavity depth, i.e. the maximum leg length, in a region of about ⅓ to ⅔ of the respective length of the C-profile.

According to a preferred embodiment of the present invention, the C-profiles of the segments arranged in the lower, i.e. handle-facing region of the racket head transition into the heart region and/or the bridge of the racket. For example, the inner surface of the side region of the inner side of the frame transitions uniformly into the bridge. According to an alternative preferred embodiment, the cavity formed in the inner side of the frame transitions continuously into the bridge. If the side regions or flanks of the frame project inwardly, a top view of the racket shows in the respective segments, i.e. at about 4.30 o'clock to 5 o'clock, an inwardly projecting bulge of the frame, which imparts to the frame a characteristic design and an increased flexural strength in this area. In this embodiment, the heart bridge of the frame is lowered relative to the inner side of the frame towards the racket handle in the regions following the heart bridge and, additionally, also its height can be reduced in order to intensify this impression. The contour of the inwardly projecting side regions or flanks of the frame can preferably smoothly transform into the contour of the inner side of the respective arm of the heart region of the racket.

In the area of about 12 o'clock, 3 o'clock, 6 o'clock and/or 9 o'clock, preferably no C-profile, as described above, is realized, and the cross-section of the frame profile does not show any concave portions.

By an optimized change in the cross-sectional profile of the racket frame in the head region, the C-profile allows a change in the vibration or damping behavior along the frame so that an optimized vibration or damping behavior is achieved. To this end, in particular the provision of the C-profile in the described regions as well as the alternating arrangement of frame portions with C-profile and frame portions without C-profile turns out to be advantageous. Particularly advantageous is also a cross-sectional profile of the C-shape in which the profile changes along the racket frame. The C-profile moreover leads to an optimum mass distribution of the entire racket mass and a change in or optimization of the stiffness of the racket along the course of the frame. Thus, it is possible to influence the playability characteristics of the racket.

Moreover, the player subjectively feels a larger sweet spot, which in particular improves the playability characteristics of the racket. Furthermore, the racket of the present invention allows an elongation of the longitudinal and transverse strings in the regions having a C-profile and thus an elongation of the freely floating string lengths. Moreover, the string lengths of the transverse and longitudinal strings are adjusted relative to one another so that the difference in their lengths becomes smaller, which leads to improved striking and playability characteristics of the racket. Hence, the racket of the present invention provides in particular an increased striking surface with constant frame dimensions. An increased striking surface has a disproportionate effect on the equation for calculating the striking force (power equation). Already a striking surface that is increased by 2% to 3% thus leads to an increase in the racket performance by 5 to 30%. The present invention allows in particular the provision of an enlarged striking surface with an otherwise unchanged outer racket contour.

Moreover, since the stringing is covered by the C-profile, a racket is provided which in particular has a striking surface that is larger than subjectively felt and which thus improves the subjective playability.

It is particularly preferred to design a racket so as to have a vibrating means according to the present invention as well as a C-profile according to the present invention at at least two segments of the head region.

In the following, preferred embodiments of the racket of the present invention are described in more detail on the basis of the drawings in which FIG. 1 is a front view of a first embodiment of a racket according to the present invention without vibrating means;

Figure 6:
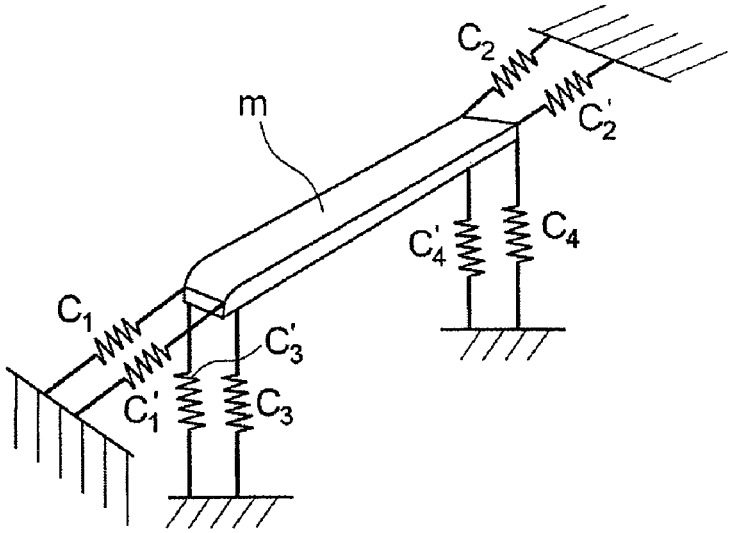
Figure 5:
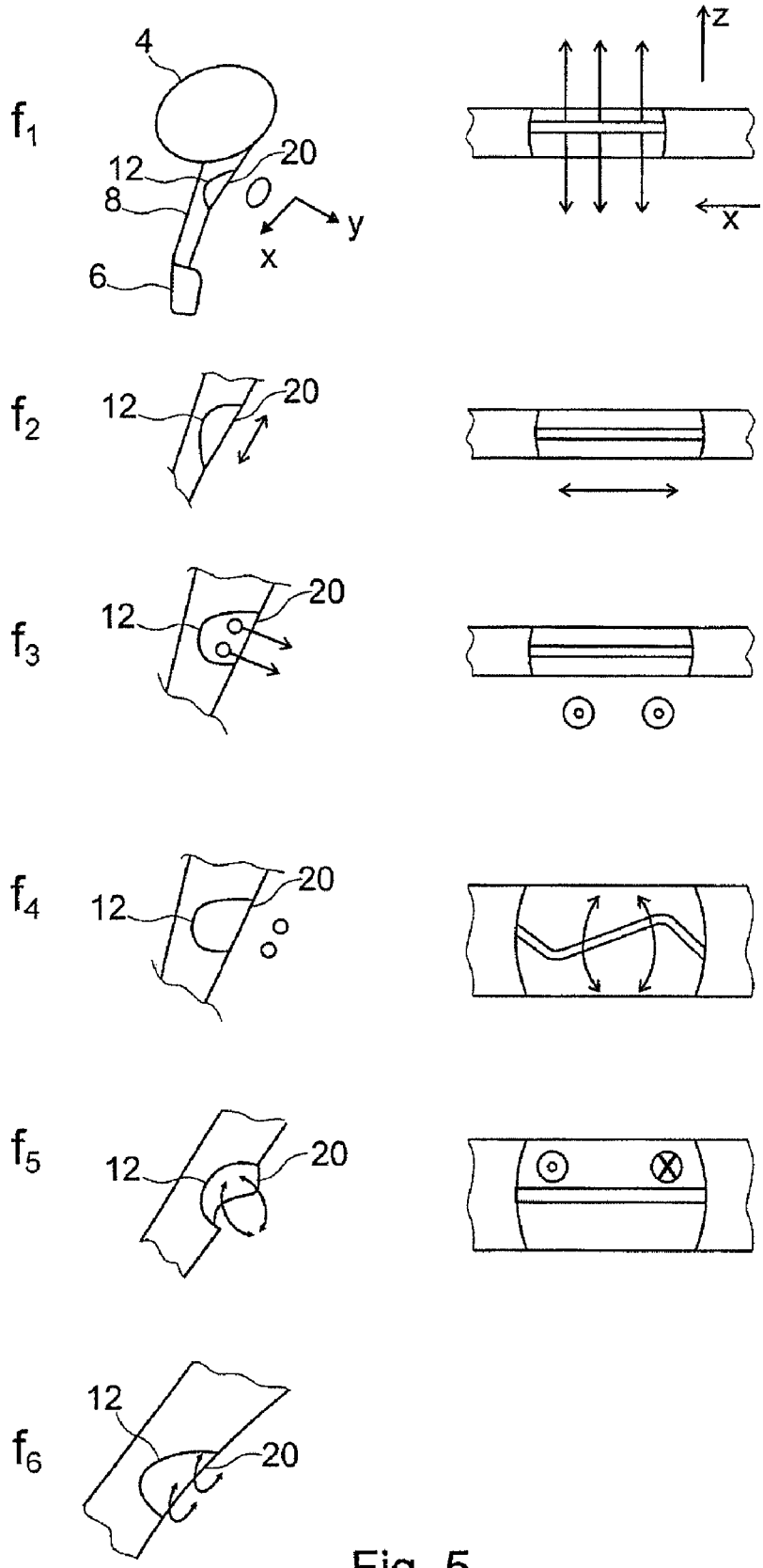
Figure 7:
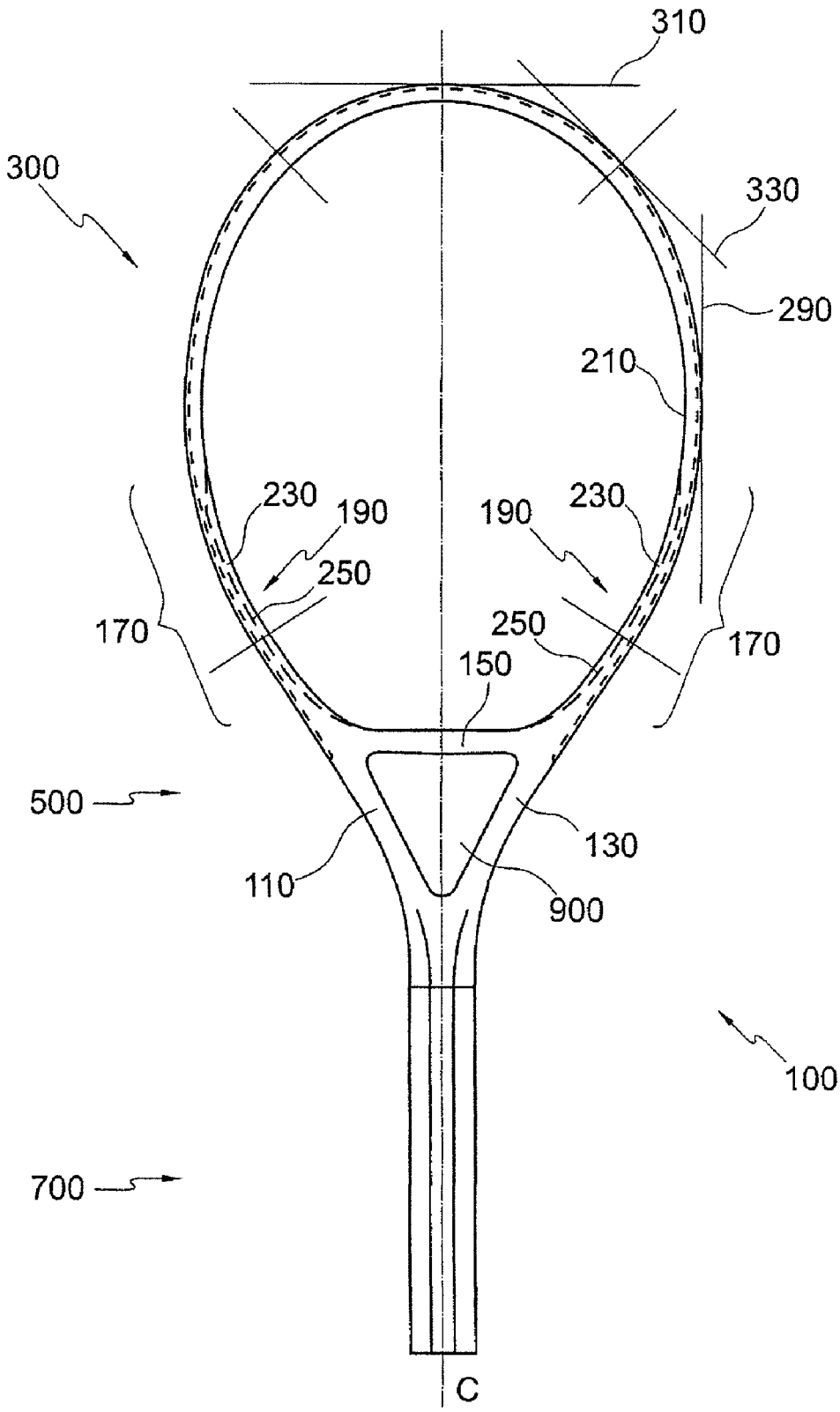
Figure 8:
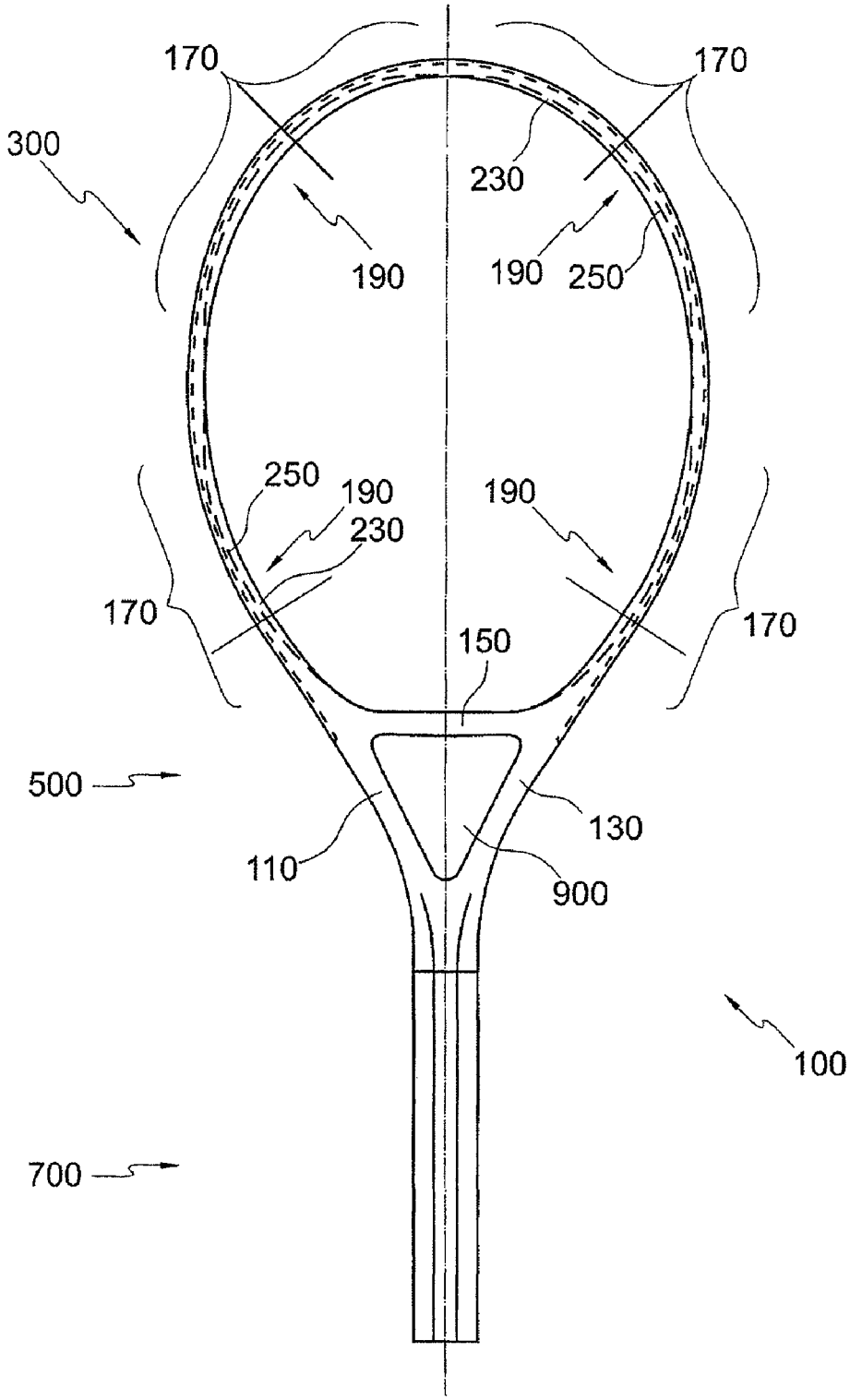
Figure 9:
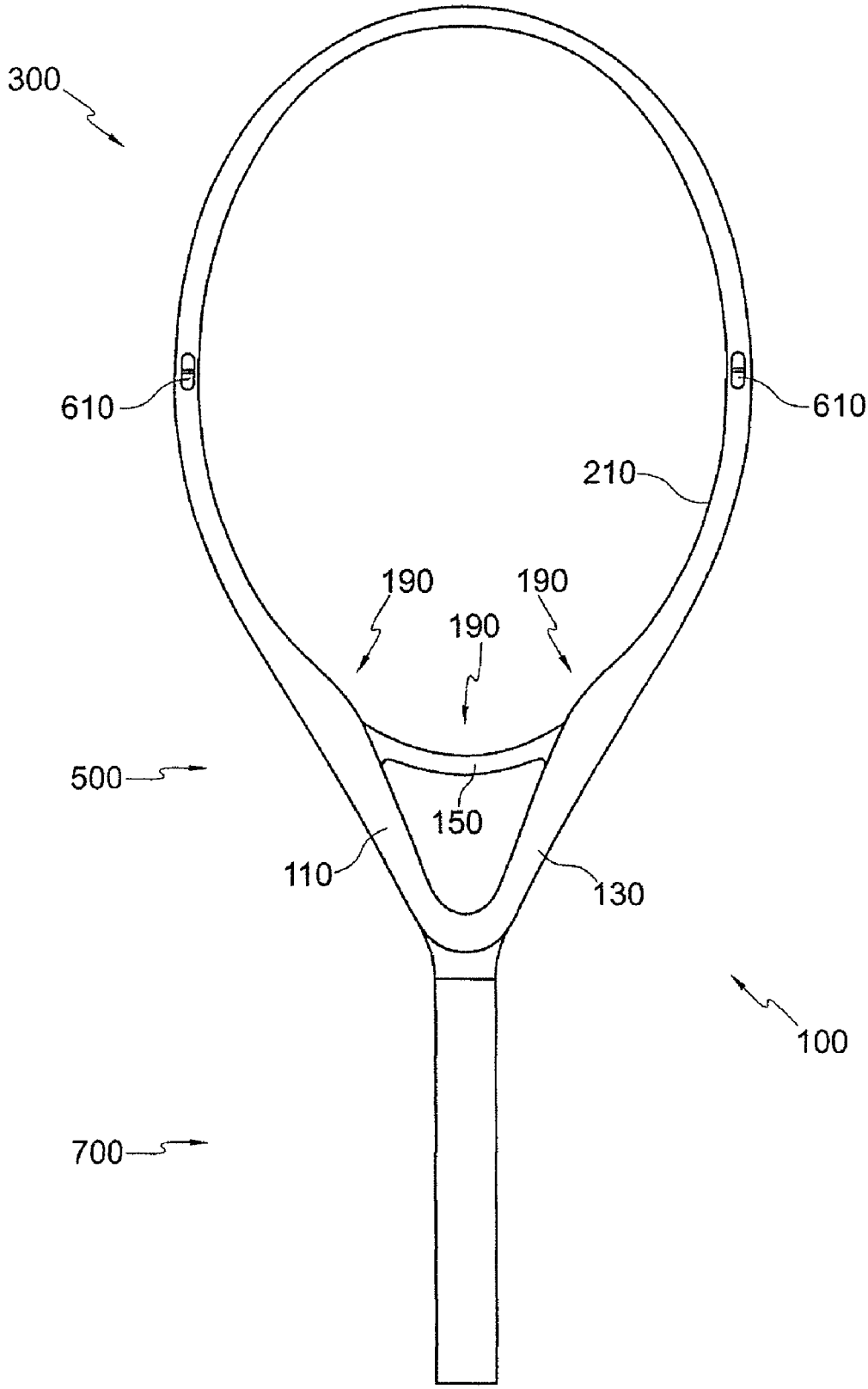
Figure 10:
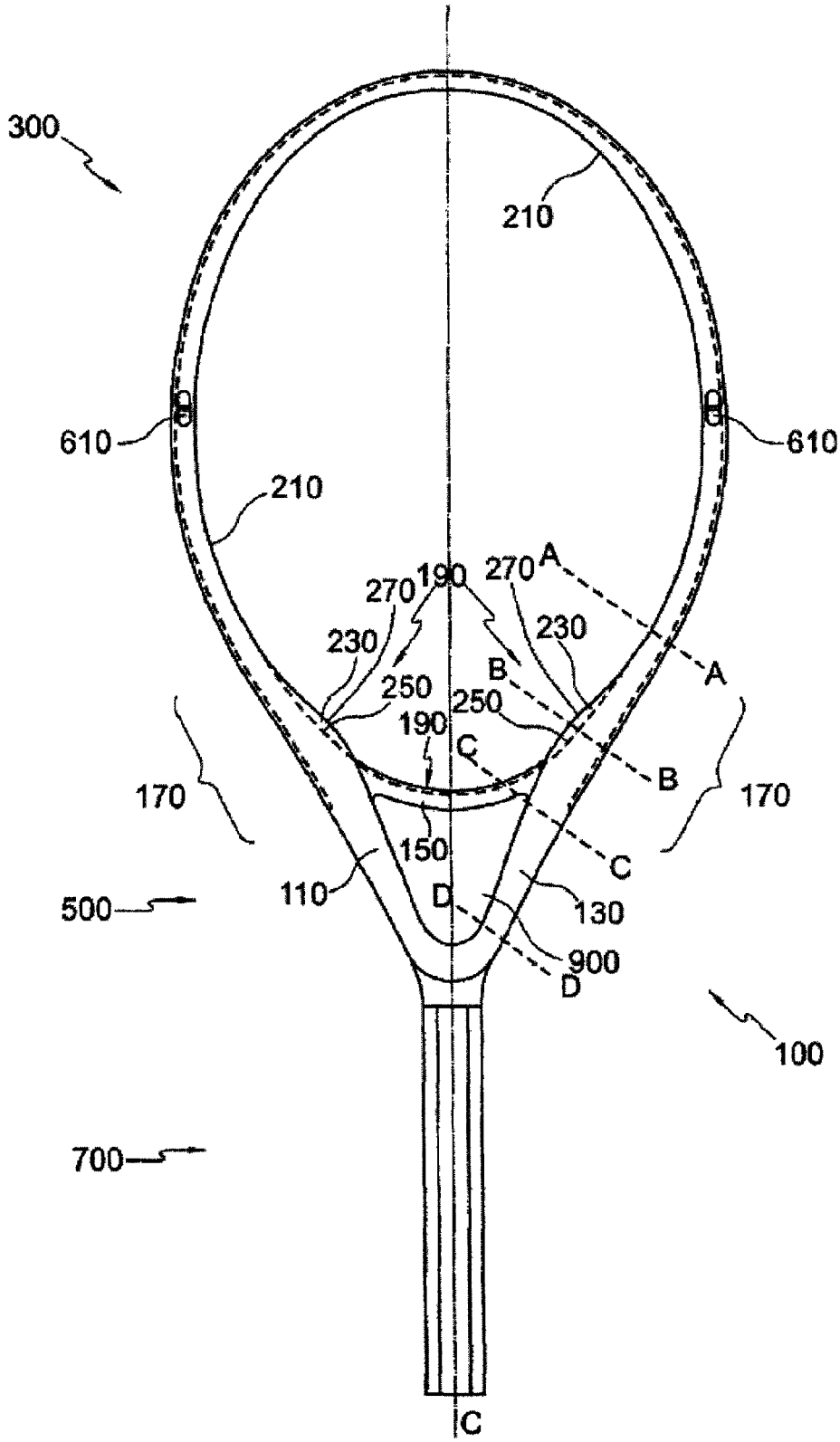

FIGS. 4*a*-4*d* are schematic views of further embodiments of vibrating means;

FIG. 5 is a schematic view of the available vibration modes or degrees of freedom of the vibrating means provided by the racket according to the present invention;

FIG. 6 is a principle view of a vibrating means according to the present invention;

FIG. 7 is a top view of a ball game racket according to a preferred embodiment of the present invention with C-profile;

FIG. 8 is a top view of a ball game racket according to a preferred embodiment of the present invention with C-profile;

FIG. 9 is a top view of a ball game racket according to a preferred embodiment of the present invention with C-profile;

FIG. 10 is a top view of a ball game racket according to a preferred embodiment of the present invention with C-profile;

FIG. 11 shows different frame profiles of a racket according to a preferred (FIGS 11*a*-11*f*) embodiment of the present invention according to FIG. 10; and FIG. 12 is a principle view of an embodiment of a racket according to the present (FIGS 12*a*-12*b*) invention with C-profile.

Figure 1:
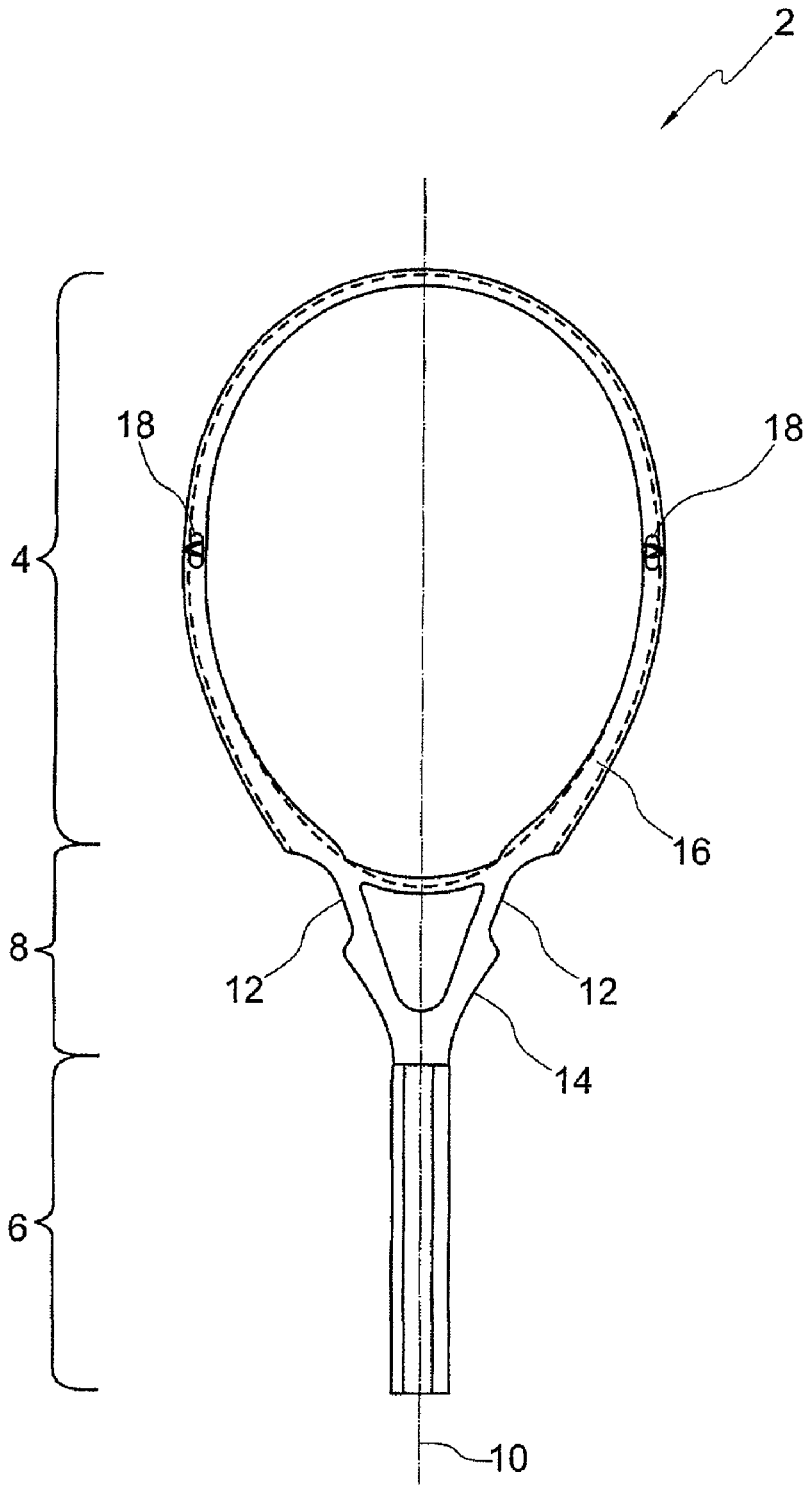

In accordance with FIG. 1, the racket 2 according to the present invention comprises a racket head 4, a handle portion 6 and a heart region 8 provided therebetween. In accordance with the present invention, one respective indentation 12 is provided in the heart region 8 at the outer side 14 of the frame 16 forming the racket 2 symmetrically with respect to the longitudinal axis of the racket 2.

In the area of about 3 o'clock and 9 o'clock, the racket head 4 preferably comprises so-called "flex points" 18 as described in more detail in DE 10 2004 003 528 and DE 10 2004 003 526. To this end, four trough-shaped indentations are provided essentially in the area of the racket head, said indentations being arranged opposite to one another in pairs at the front and rear sides and essentially symmetrically with respect to the longitudinal axis of the racket. Each pair of opposite indentations can have an opening extending essentially perpendicularly with respect to the stringing plane of the racket through the frame profile.

Moreover, a racket according to the present invention has an essentially C-shaped cross-sectional profile preferably at both sides of the longitudinal axis 10 in regions of the racket head that face towards the heart region, the legs of the C extending into the stringing surface. In FIG. 1 this is shown by the full and dashed lines. This will be dealt with in more detail in connection with the description of FIGS. 7 to 12.

Figure 2:
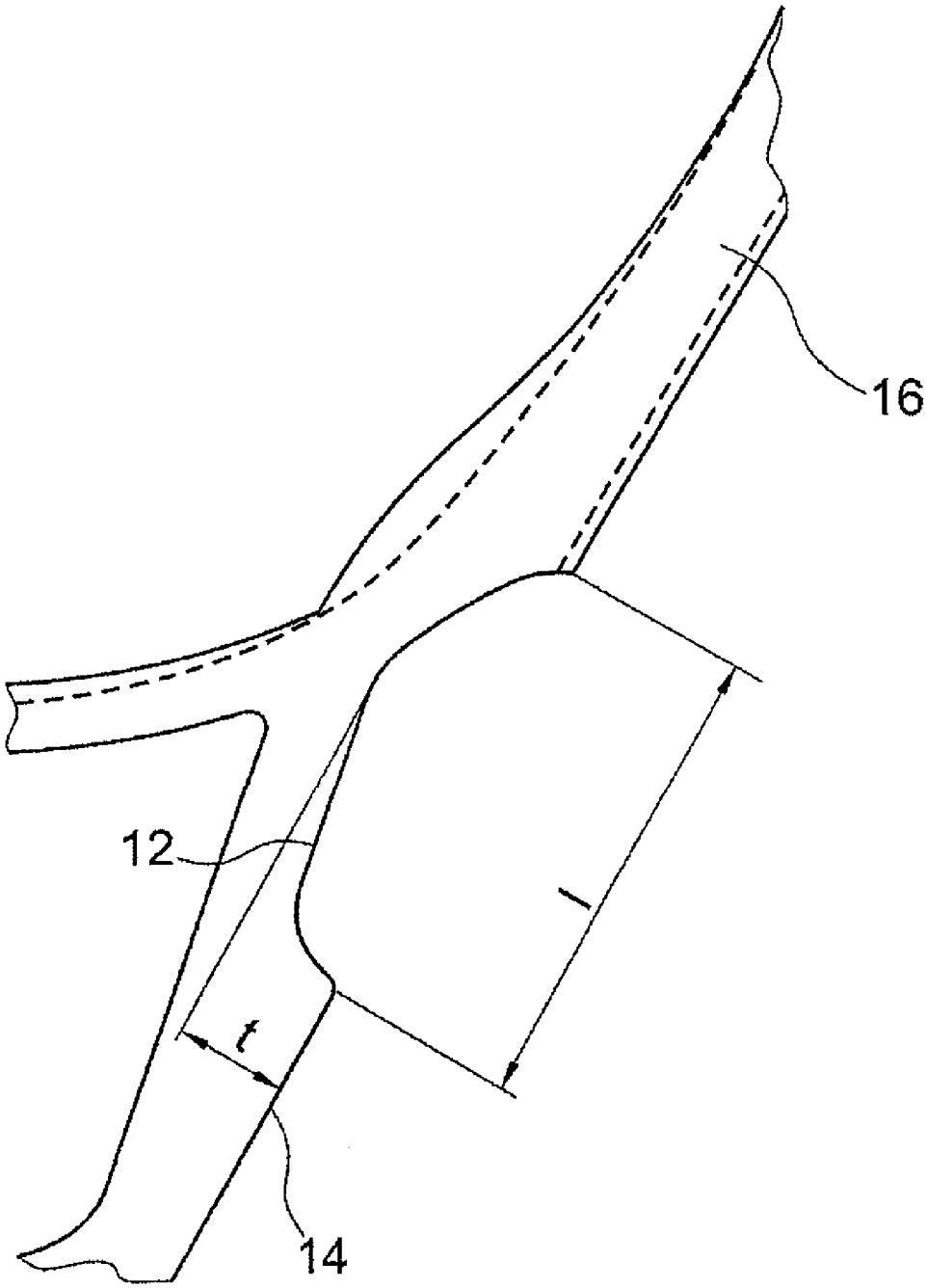
FIG. 2 is a detailed view of an indentation in the heart region of the racket according to the present invention.

The indentation 12 in the racket according to the present invention is shown in more detail in FIG. 2. In accordance with FIG. 2, the indentation 12 extends in a direction parallel to the stringing plane of the racket. The indentation 12 reduces the cross-sectional profile of the frame 16 in the area of the indentation. The indentation itself has preferably a length l of about 40 mm to 100 mm, more preferably 50 mm to 80 mm and most preferably 60 mm to 70 mm. The maximum depth t of the indentation transversely with respect to the frame is preferably about 5 mm to 30 mm, more preferably 10 mm to 20 mm and most preferably 14 mm to 17 mm. The indentation preferably extends through the overall thickness of the frame profile, i.e. from the front side of the racket to the rear side of the racket.

Figure 3:
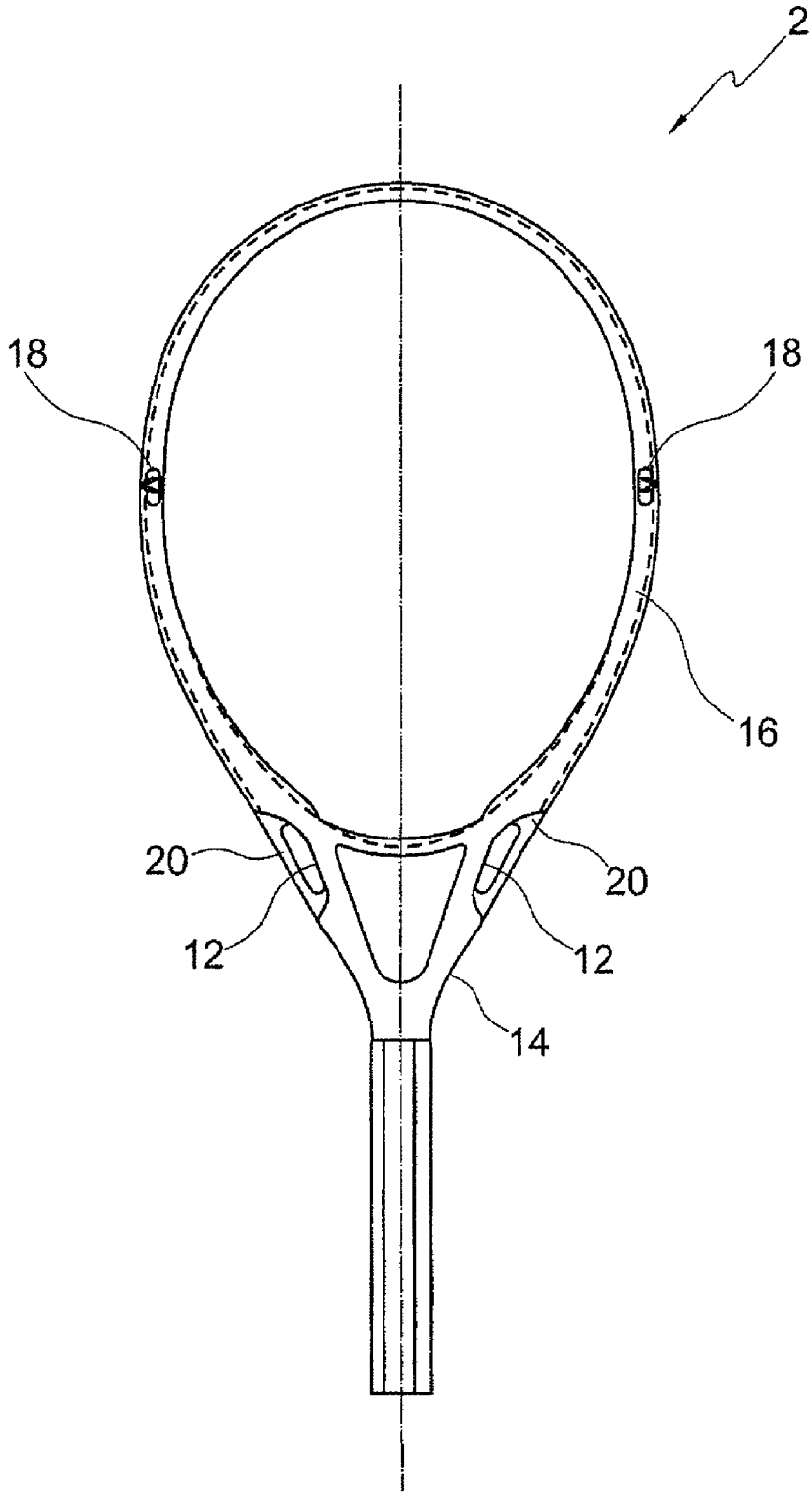
FIG. 3 is a front view of the racket according to the present invention similar to FIG. 1 but with vibrating means.
Figure 4:
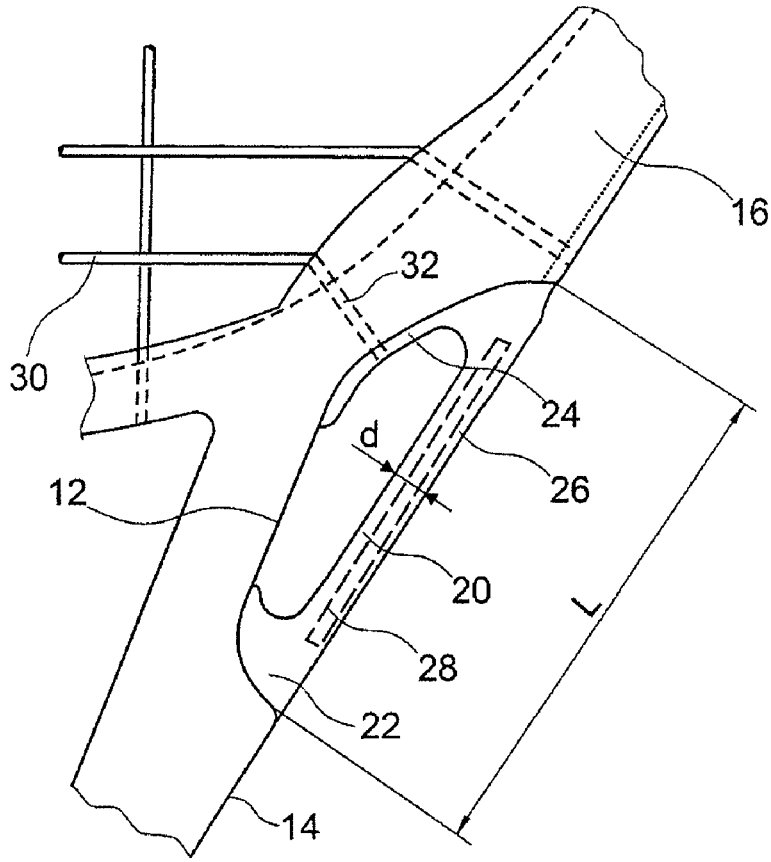
FIG. 4 is a detailed view of an indentation with vibrating means.

FIG. 3 shows the racket 2 according to the present invention, comprising two vibrating means 20 being mounted in the indentations 12 symmetrically with respect to the longitudinal axis of the racket. An enlarged view of an indentation 12 comprising a mounted vibrating means 20 is shown in FIG. 4. As shown in FIG. 4, the vibrating means 20 is preferably shaped and dimensioned such that it is received in the indentation 12 in such a manner that the outer circumferential surface 14 of the frame extends essentially continuously over the vibrating means 20. To this end, according to the embodiment shown in FIGS. 3 and 4, the vibrating means comprises a first mounting portion 22, a second mounting portion 24 and a bridging portion 26 connecting the two mounting portions. The two mounting portions 22, 24 and the bridging portion 26 are preferably made of a viscoelastic material or an elastic material as an integral component.

Materials that can be used for this component are in particular elastomers such as natural rubber, rubber or foam materials, e.g. silicone rubber. The two mounting portions 22, 24 and the bridging portion 26 form a spring element of the vibrating means. A mass part 28 is provided in or at the spring element. Preferably, the mass part 28 is embedded in a hollow space of the bridging portion 26. Alternatively, the mass part can also be arranged at a surface of the spring element. Moreover, it is also possible to provide a plurality of mass parts 28. It is also possible that a plurality of connection regions are provided between the mounting portions and the bridging portion. The frame-side curvatures of the mounting portions 22, 24 preferably correspond essentially to the curvatures of the indentation 12 at the frame 16 of the racket so that there is a form-fit contact to the mounting portions.

For passing a string 30 through the frame 16 in the area of the vibrating means, in particular in the area of the second mounting portion 24, it is preferable that in the area of a string inlet or outlet opening 32 the mounting element 24 is shaped like a fork having a recess (not shown). The string 30 can be guided in this recess in the area of the mounting portion 24 by using a conventional eye band.

The vibrating means 20 is preferably mounted in the indentation 12 by gluing the contact surfaces of the mounting portions 22, 24 to the opposing surfaces of the frame 16. Preferably, the contact surface and the opposing racket surfaces have corresponding contours for achieving an improved attachment and/or coupling of the vibrating means to the frame. The length L of the vibrating means extending in the direction of the X-axis essentially corresponds to the length l of the indentation 12. The bridging portion 26 has preferably a length of at least 50%, more preferably at least 75% and even more preferably at least 85% of the overall length L of the vibrating means 20. The width of the bridging portion 26 (in the direction perpendicularly with respect to the paper or racket plane, i.e. in the Z-direction) is preferably smaller than the frame height of the racket in this region. Typically, the width of the bridging portion 26 is smaller than 50%, more preferably smaller than 40% of the frame height in this portion. The width of the bridging portion thus ranges, e.g., between 2 mm and 25 mm, more preferably between 5 mm and 15 mm and most preferably between 7 mm and 10 mm. The width d of the bridging portion 26 as measured in the racket plane in the Y-direction preferably ranges between 1 mm and 5 mm, more preferably between 2 mm and 4 mm. The width of the mounting portions 22, 24 is preferably larger than the width of the bridging portion and is limited by the height of the frame profile 16. Typically, in the contact region to the frame the width of the mounting portions 22, 24 is about 10 mm to 40 mm, more preferably 15 mm to 30 mm and most preferably 25 mm to 28 mm.

Figure 4A:
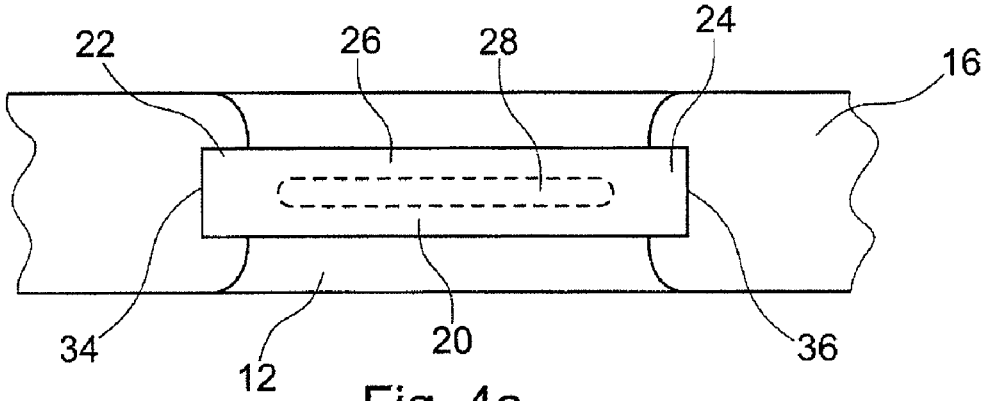
Figure 4B:
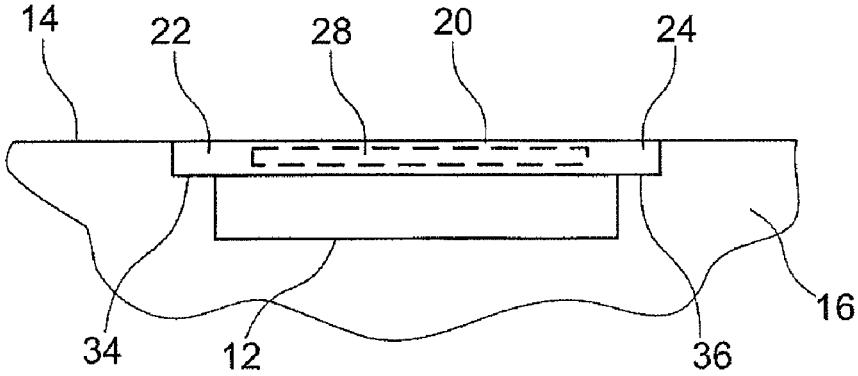

FIGS. 4*a* to 4*b* show an alternative embodiment of a vibrating means 20 provided in the heart region 8 of a racket 2 according to the present invention. FIG. 4*a* shows a side view of the frame 16 and the vibrating means 20, and FIG. 4*b* shows a front view similar to that of FIG. 4. According to this embodiment, the vibrating means 20 has essentially the shape of a cuboid, with the mass part 28 being embedded in a bridging portion 26 similarly to the embodiments described above. In this embodiment, the mounting portions 22, 24 of the vibrating means 20 do not have a specific shape, but they are formed by the opposing ends of the bridging portion. For mounting the vibrating means 20 to the racket frame 16, the frame 16 comprises opposite recesses 34, 36 in which the mounting portions 22, 24 of the vibrating means 20 are preferably received in an essentially form-fit manner. Similarly to the embodiment described above, the mounting means itself can preferably be attached by gluing. The indentation 12 of this embodiment can—as shown—be less continuous than in the embodiment shown in connection with FIGS. 1 to 4, namely for example it can have relatively abrupt changes in the contour of the frame profile, and it can be essentially rectangular in the cross-section of the frame. However, also in this embodiment it is possible to configure the frame profile by less abrupt profile changes, similarly to the embodiments according to FIGS. 1 to 4.

Figure 4C:
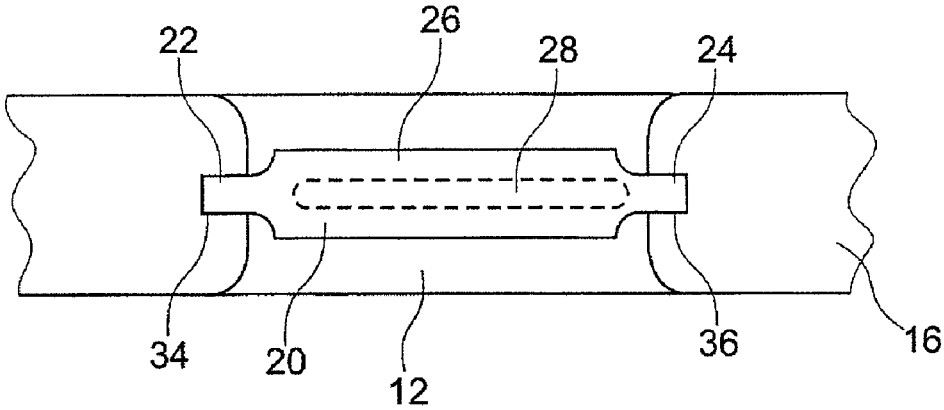

The embodiment shown in a side view of the frame 16 according to FIG. 4*c* essentially corresponds to the embodiment of FIGS. 4*a* and 4*b*, although the mounting portions 22, 24 of the vibrating means 20 are narrower than the bridging portion 26 so that the vibration behavior of the vibrating means 20 can be varied in the respective vibrating directions or modes.

Figure 4D:
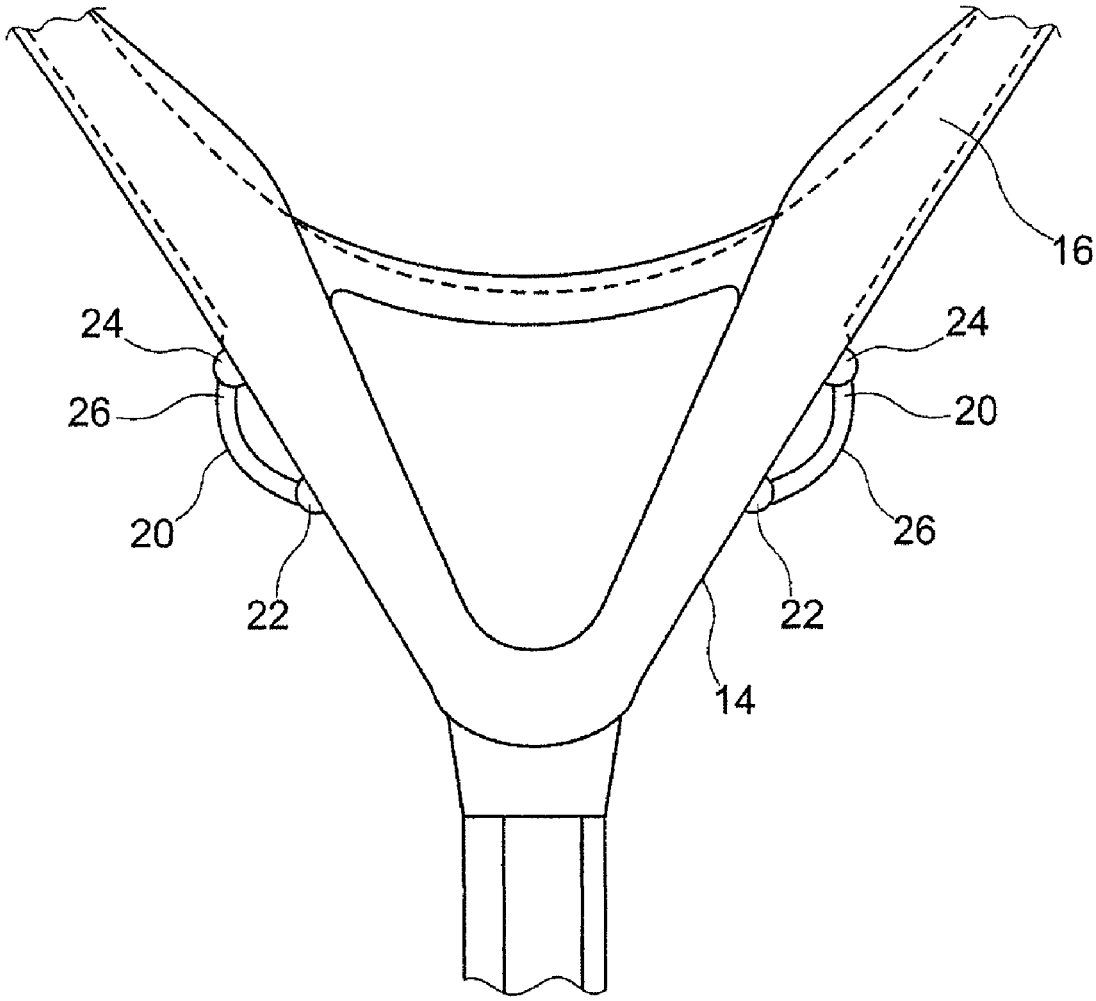

A further embodiment of the racket according to the present invention is schematically shown in a front view in FIG. 4*d*. According to this embodiment, the vibrating means 20 is attached to the racket frame 16 in the heart region 8 without indentation. To this end, the mounting portions 22, 24 are attached to the outer circumferential surface 14 of the racket frame 16, and the bridging portion 26 connects the two mounting portions 22, 24 with each other, e.g. in a curved manner. The mass part, which is not shown in FIG. 4*d*, can be embedded in the bridging portion 26 and can, e.g., be smaller than the bridging portion 26, as shown in FIGS. 4 to 4*c*. However, the mass part can also form the entire bridging portion. In this embodiment, too, the vibrating means 20 advantageously have various vibration modes, as already discussed in connection with the above embodiments.

FIG. 5 schematically shows six different vibration modes having the frequencies $f_1$ to $f_6$. On the left-hand side of FIG. 5 a top view of the racket or the vibrating means being arranged in the indentation of the racket frame is shown, i.e. the X-Y plane is shown. The illustrations on the right-hand side of FIG. 5 show a side view or top side view of a vibrating means being arranged in an indentation of the racket frame, i.e. the X-Z plane. The respective deflections of the vibrating means are adumbrated schematically.

When vibrating at the frequency $f_1$, the vibrating means is deflected in the Z-direction. In the vibration mode having the frequency $f_2$, the vibrating means is deflected in the X-direction, i.e. in the longitudinal direction of the vibrating means. In the vibration mode having the frequency $f_3$, the vibrating means vibrates in the Y-direction. In the vibration mode having the frequency $f_4$, a rotational vibration of the vibrating means about the Y-axis takes place; this can be called "pitching" relative to the longitudinal direction of the vibrating means. In the vibration mode having the frequency $f_5$, a rotational vibration about the Z-axis takes place; this can be called "yawing" relative to the longitudinal direction of the vibrating means. Finally, in the vibration mode having the frequency $f_6$, a rotational vibration about the X-axis takes place; this can be called "rolling" relative to the longitudinal direction of the vibrating means. The vibrating means practically rotates about its longitudinal axis, which is not shown in the side view.

FIG. 6 shows a schematic model or diagram of a vibrating means according to the present invention, in which the mass m in the form of a bar is suspended by eight springs having spring constants $c_1$, $c_{1'}$ to $c_4$, $c_{4'}$ in an indentation in the racket frame that is only adumbrated in the Figure. FIG. 6 is a schematic perspective view. FIG. 6 shows that the frequencies of the individual vibration modes of the vibrating means can be varied or tuned by varying the mass m and the spring constants $c_1$ to $c_{4'}$, so that a desired damping characteristic and racket acceleration can be adjusted. The individual pairs of springs $c_1$, $c_{1'}$ to $c_4$, $c_{4'}$ can either have the same or different spring constants. Optionally, also each of the pairs of springs $c_3$, $c_{3'}$ and $c_4$, $c_{4'}$ can be replaced by one single spring $c_3$ and $c_4$, respectively, because the restoring force required in case of deflection can be provided by the two pairs of springs $c_1$, $c_{1'}$ and $c_2$, $c_{2'}$.

A further preferred embodiment of the ball game racket 100 according to the present invention is shown in FIG. 7. The basic structure of the racket 100 according to the present invention essentially corresponds to that of a conventional ball game racket. Accordingly, the racket 100 according to the present invention comprises a head region 300, a heart region 500 as well as a handle portion 700. As described above, the heart region 500 of the racket according to the present invention is essentially the connection region between the head region 300 and the handle portion 700 and, e.g., comprises an opening 900. The opening 900 is formed by two side portions or arms 110 and 130 as well as a connection portion or bridge 150 in the head region 300 of the racket 100. The heart region 500 of the racket 100 according to the present invention can also have no opening 900, contrary to the embodiment shown in FIG. 7, i.e. the handle portion 700 can extend in a closed manner to the head region 300. Also the connection element or bridge 150 is optional. Consequently, the heart region 500 can also be formed only by the elongations 110 and 130 of the head region extending towards the handle portion 700. Furthermore, the heart region 500 can comprise a second connection element (not shown).

As already discussed above, the racket 100 according to the present invention is based on the idea to provide in at least two segments 170 a respective C-profile 190 that is inwardly oriented, i.e. opens towards the stringing (not shown).

In this connection, C-profile 190 means a cross-sectional profile that is essentially C-shaped, i.e. has roughly the shape of half a ring and comprises a base side or web and two legs. Such a C-profile can be angular, round, tapered and/or also flat or wide. For example, such a C-profile is defined by providing a groove, trough or indentation 230 extending along the frame contour on the inner side of the frame 210. In the illustration of FIG. 7, the groove or indentation 230 is hidden by the side region of the frame or a leg of the C-shaped profile. Only the lower side or bottom 250 of the groove is dashed as a hidden line. Here, the stringing extends into the C-profile so that the legs or flanks 270 of the C-profile 190 or its ends project beyond the stringing, i.e. extend over and below the stringing. In the area of the racket head 400, the frame preferably comprises a plurality of through holes lying essentially in the stringing plane and serving for passing strings therethrough. Said through holes are formed in the region of the segments 170 or in the C-shaped profile in the area of the inner region of the inner side of the frame or in the area of the trough or indentation 230, i.e. open in the bottom 250 of the trough or indentation 230.

The head of the racket 100 shown in FIG. 7 has an oval shape, but it can have almost any shape as described above. In the embodiment shown in FIG. 7, the C-shaped sections of the profile 190 or segments 170 are arranged approximately between 3.30 o'clock and 5.30 o'clock and between 6.30 o'clock and 8.30 o'clock. According to a further preferred embodiment as shown in FIG. 8, two further segments 170 or C-shaped profiles 190 are arranged between about 12.30 o'clock and 2.30 o'clock as well as between 9.30 o'clock and 11.30 o'clock. Preferably, the frame has a C-profile in accordance with the invention in at least two of said regions. The entire racket is preferably mirror-symmetric along its longitudinal axis C, i.e. the respective segments 170 or C-profiles 190 on the left and right racket halves are identical relative to the longitudinal axis C.

According to a further preferred embodiment of the present invention, the C-profiles 190 or segments 170 are provided approximately about the region of the contact point between the racket frame and the upper and/or lower 45° tangents of the racket frame. As shown in FIG. 7, the 45° tangent is the tangent contacting the outer contour of the racket frame at an angle of about 45°, wherein the perpendicular tangent 290, which extends parallel to the C-axis, is called 0° tangent, and the horizontal tangent 310, which extends perpendicular with respect to the C-axis, is called 90° tangent. The 45° tangent sketched in FIG. 7 in the right upper half of the racket is marked as 330. The symmetrical 45° tangent on the left upper half of the racket as well as the two 45° tangents in the lower half of the racket are sketched in FIG. 7 either. Their positions on the racket head relative to the "time" position depend on the frame of the racket head.

Typically, the C-profiles extend approximately symmetrically about the 45° tangents, approximately from the 20° tangent to the 70° tangent.

The segments 170 or C-profiles 190 are preferably formed in the regions of the frame in the head region of the racket in which the maximum torsional load occurs when playing with the racket, i.e. in which the maximum torsional stress can be expected. Preferably, these regions are mirror-symmetrical with respect to one another relative to the C-axis and are provided two times in the lower region of the racket head and two times in the upper region of the racket head.

In the embodiment shown in FIG. 7 and FIG. 8, the C-profile 190 is preferably configured such that a dashed inner region of the inner side 210 of the frame is backwardly offset outwardly relative to its normal course and relative to the side regions of the inner side of the frame so that a trough 230 is formed in the frame profile and the frame profile has a C-shaped cross-sectional structure. In a top view (from the stringing plane) of the inner side 210 of the frame in the region of the C-profile 190, such a trough 230 is preferably arranged in the center of the frame. The corresponding side regions are not offset backwardly relative to the inner region of the inner side 210 of the frame in the region of the C-profile 190 but follow essentially the frame contour as defined by the regions not having a C-profile. Thus, the contour of the racket of FIG. 7 in segments 170 having a C-profile 190, as shown in the lower region of the racket head at about 5 o'clock and at about 7 o'clock, equals the corresponding regions in the upper region of the racket head at about 11 o'clock and at about 1 o'clock at which no C-profile is provided in the preferred embodiment shown in FIG. 7.

Preferably, in the relevant segments 170 the frame profile gradually changes or transitions into the C-profile until it reaches its maximum characteristic, then it transitions again, likewise in a gradual manner, into the frame profile without C-shape.

FIGS. 9 and 10 show a further preferred embodiment of a ball game racket having a C-shaped profile in portions of the head region. In the preferred embodiment of FIG. 9, which shows the outer contour of the racket 100, the C-profile as such is not evident. In contrast thereto, FIG. 10 shows—in dashed lines—also hidden lines so that the realization of a C-profile 190 in segment 170 becomes clear. In the preferred embodiment of FIG. 10, the C-profile is arranged approximately in the region of 5.00 o'clock to 5.30 o'clock as well as approximately in the region of 6.30 o'clock to 7.00 o'clock. The C-profile of FIG. 10 differs from the C-profile of FIGS. 7 and 8 in that in accordance with this embodiment the side regions of the inner side 210 of the frame extend inwardly relative to their normal course so that they project relative to an inner region of the inner side 210 of the frame.

As shown in FIG. 10, the (dashed) inner region of the inner side 210 of the frame transitions from the portion 170 having a C-shaped profile 190 gradually into the bridge 150, while the side regions of the inner side of the frame that form the legs or flanks 270 of the C-shaped profile project inwardly and then transition at the handle-facing end of the segment 170 having a C-shaped profile 190 gradually into the arms 110 or 130 of the heart region 500 of the racket 100. By the inwardly projecting flanks 270 of the C-profile, additional material is provided at these sites of the racket head, i.e. approximately between 5 o'clock and 5.30 o'clock, said material having a maximum distance from the neutral fiber so that the flexural stiffness is increased. According to this embodiment, also the bridge 150 of the heart region 500 can have a comparatively faint C-profile 190 according to the present invention (shown in dashed lines in FIG. 10).

Preferably, the racket head 300 comprises again so-called "flex points" 610, as described in more detail in DE 10 2004 003 528 and DE 10 2004 003 526, in the region of about 3 o'clock and 9 o'clock.

FIG. 11 shows views of the profile at different positions along the frame profile of the ball game racket 100 shown in FIG. 10. FIG. 11*a* shows a cross-sectional view of the profile of the racket 100 according to FIG. 10 along section A-A, FIG. 11*b* along section B-B, FIG. 11*c* along section C-C and FIG. 11*d* along section D-D. FIG. 11*a* exemplarily shows a cross-sectional profile of a ball game racket according to the present invention outside the segments 170 having a C-shaped profile 190. In this region, the racket comprises only at its outer side a trough 350 for receiving, e.g., a wear frame or head band (not shown). FIG. 11*b* shows the cross-sectional profile of a ball game racket according to the present invention in the region of segments 170 having a C-profile 190.

The trough 230 formed in the inner region of the inner side 210 of the frame is clearly visible. Said trough 230 is defined by the projecting side regions 370 of the inner side 210 of the frame, so that a C-profile 190 being oriented towards the inner side of the racket is formed.

As discussed in connection with FIG. 10, the C-profile 190 is configured in that the side regions 370 project as legs 270 of the C-profile 190 inwardly relative to the normal course of the inner side 210 of the frame, in FIG. 11*b* shown in dashed lines as 410, i.e. project towards the stringing and thus form the trough 230. At legs 270 of the C-profile 190, the profile of the frame may be at least 10% wider than at the web of the C-profile 190 connecting legs 270.

FIGS. 11*c* and 11*d* exemplarily show further cross-sectional profiles of a ball game racket according to the present invention outside the segments 170 and without C-profile 190.

FIG. 11*e* shows the cross-sectional profiles of FIGS. 11*a* to 11*d* in an overlapped manner, and FIG. 11*f* shows the course of the frame profile in the top view of FIG. 9 in the region of the sections A-A to D-D.

The circumference of the frame profile is about 120 mm in the cross-section shown in FIG. 11*b*, in the cross-section of the head region (see, e.g., FIG. 10 at 12 o'clock) only about 67 mm. Preferably, the ratio of the maximum circumference at the C-profile relative to a minimum circumference in the head region is at least about 1.4, preferably at least about 1.6, particularly preferably at least about 1.75. Such a varying circumference allows various favorable stiffnesses in the circumference due to the C-profile.

In the cross-section of FIG. 11*b* and in general, the ratio of circumference and enclosed surface is much higher in the region of the C-profile than without C-profile. The combination of this ratio of circumference and surface with the variation of the circumference of the frame profile as described above allows particularly advantageous properties to be achieved in view of bending force torsion hindrance and torsional properties in general.

All known materials for tennis rackets, squash rackets, badminton rackets, paddle tennis rackets and other rackets for ball games are suitable as the material for the racket 100 according to the present invention. In particular, the racket 100 according to the present invention can be made of wood, metal, metal alloys, plastics materials, carbon fiber compound materials, fibrous materials, compound materials and combinations thereof.

By realizing an inwardly opened C-profile in selective portions of the head region, the racket according to the present invention allows an optimized change in the cross-sectional profile of the racket frame. The reduction in the torsional strength in the region of the C-profiles allows an optimized absorption of the corresponding forces and moments into the racket, said forces and moments being absorbed by the racket in particular in the transitions of the C-profile into the normal profile structure. Hence, the design of a ball game racket according to the present invention allows an optimization of the vibration and/or damping behavior of the racket along the frame, so that an optimized vibration and/or damping behavior is achieved, which leads in particular to improved handling or playability characteristics of the racket as well as to a reduction in the forces, impacts or vibrations acting on the player and thus to a reduction in the strain, susceptibility to illnesses and physical fatigue of the player. To this end, in particular the provision of the C-profile in the described regions as well as the alternating arrangement of frame portions with C-profile and frame portions without C-profile and in particular the creation of transitions between a frame profile with C-profile and a frame profile without C-profile turns out to be advantageous. Particularly advantageous is also a C-profile that changes within the respective segments along the racket frame, wherein advantageously the depth, width and shape of the trough or the length, width and shape of the legs change continuously and preferably uniformly.

In this connection, the different C-profile designs as described, e.g., on the basis of FIGS. 7 and 10 basically do not change. However, the different ways of designing a C-profile allow optimized racket properties depending on the required use. According to a preferred embodiment, the two kinds of C-profiles can also be combined in one racket, wherein, however, the racket is preferably mirror-symmetrical along its longitudinal axis as described above.

The C-profile according to the present invention moreover leads to an optimized mass distribution of the entire racket mass. In particular, by the provision of such a C-profile, besides the above-mentioned advantages also an optimized positioning of the racket's center of gravity can be achieved. To this end, in particular by the inwardly projecting C-shaped profile as shown, e.g., in FIG. 10, the racket's center of gravity can be shifted to the heart region, which leads in particular to a power-saving handling and, therefore, to an improved playability of the racket.

Moreover, the realization of a C-profile as described, e.g., in connection with FIG. 8 leads to an increase in the striking surface and, therefore, to improved playability characteristics. In particular, the freely floating string length of the longitudinal and/or transverse strings of the racket's stringing can be increased, which also leads to improved playability characteristics of the racket.

FIG. 12 shows a principle view of an embodiment of the racket according to the present invention; by the provision of four segments having a C-shaped profile, the surface at which the strings exit the frame can be offset outwardly relative to a normal cross-sectional profile, leading to an elongation of the freely vibrating strings. FIG. 12*a* sketches the position of the eye point 510 of a conventional racket profile and the position of the eye point 530 of the racket profile according to the present invention, and an elongation of the respective string 550, 550' by a length $\Delta s$ is shown. When accordingly aligning C-profiles that are opposite to one another (in the longitudinal and/or transverse direction), an elongation $\Delta s_1+\Delta s_2$ is achieved, as shown in FIG. 12*a*. FIG. 12*b* shows a principle view of a conventional string 550, 550' having a length L, which is hit by a ball 570 and is thus deflected by $\Delta x_1$. In contrast, a string 550, 550' according to the present invention and having a length of $L+\Delta s_1+\Delta s_2$ is shown, which is hit by a ball 570 and thus deflected by $\Delta x_2$.

In an otherwise equal situation, the mere difference in the string length leads to the fact that the deflection $\Delta x_2$ of a string of the racket according to the present invention is greater than the respective deflection $\Delta x_1$ of a shorter string. The shorter string of the prior art is thus stiffer, which in turn leads to an increased ball deformation. Since the elasticity properties of the ball, in particular the energy restitution during an impact, are by magnitudes worse than those of the string, a large amount of the energy of the strike is lost due to the deformation of the ball. As compared thereto, the string of a racket according to the present invention undergoes a greater elastic deflection, i.e. a larger amount of striking energy leads to a greater elastic deformation of the strings, which in turn pass this energy to the ball, so that less energy is lost. A racket according to the present invention, in particular in accordance with the embodiment shown in FIGS. 9 and 10, thus allows a particularly good energy utilization, protects the player and improves the playability characteristics.

Since in particular a ball game racket designed in accordance with the present invention and comprising four segments having a C-profile, as shown in FIG. 12*a* and as also described in connection with FIG. 7 or 9, leads to an elongation of both longitudinal and transverse strings and in particular of the normally shorter strings in the upper, lower and lateral edge regions of the stringing of the racket, the ratios of the string lengths relative to one another are adjusted. Such an adjustment of the ratios of the side lengths leads in particular to an increase in the sweet spot. Hence, a racket according to the present invention allows an increase in the freely floating string length and thus an increase in the striking surface and the sweet spot with otherwise unchanged external geometry and dimensions of the racket and with the above-mentioned advantages in view of the damping and vibration behavior. A racket according to the present invention thus preferably has a striking surface that is enlarged by about 0.5 to 5%, more preferably a striking surface that is enlarged by 1 to 3% relative to a conventional racket having no C-profile according to the present invention. To this end it is pointed out that due to the situation discussed in connection with FIG. 12, the percentage increase in the striking surface has a disproportionate effect on the so-called "power equation" for calculating the striking behavior of the racket. Already a slight increase in the striking surface thus leads to a noticeable improvement of the playability behavior.

Moreover, the legs of the C-profile cover the region of the stringing that was gained by providing the C-profile. Thus, for example in the embodiment according to FIGS. 7 and 8, the racket has a head surface that is subjectively smaller than the actual striking surface due to the inwardly projecting C-profile. Hence, to the player the perceived striking surface seems to be smaller than the actual striking surface. Compared to the subjectively expected playability characteristics, a ball game racket according to the present invention thus comprises objectively considerably improved playability characteristics and in particular a sweet spot that is larger than expected by the player. Since the subjective feeling of the sportsman practicing the sport has a great influence, the player can play with the racket more favorably. As compared to the rackets known in the prior art, a ball game racket according to the present invention thus guarantees an improved vibration and/or damping and torsion behavior as well as an improved stiffness.

It turned out that the combination of the vibrating means according to the present invention as described, e.g., in connection with FIGS. 1 to 6 and the C-profile according to the present invention as described, e.g., in connection with FIGS. 7 to 12 is particularly advantageous.

An example of such a combination is shown in FIGS. 1 to 4 and 4*d*. Here, in particular the racket behavior that is improved by the C-profile and also the vibrating means according to the present invention lead to synergetic effects in view of the racket behavior according to the present invention and the related effects on the playability.

Also in combination with the above-mentioned so-called "flex points" 610, the ball game racket according to the present invention is advantageous in view of the stiffness behavior of the racket and the related effects on the playability.

The invention claimed is:

1. A ball game racket comprising a frame having a racket head, a handle portion and a heart portion provided between the racket head and the handle portion, wherein the frame comprises two indentations which are provided symmetrically with respect to the longitudinal axis of the racket and in each of which a vibrating component is arranged, and each of the vibrating components is arranged at an outer side of the frame.

2. The ball game racket according to claim 1, wherein each of the vibrating components is connected with the frame at two sites that are spaced-apart along the frame.

3. A ball game racket comprising a frame having a racket head, a handle portion and a heart portion provided between the racket head and the handle portion, wherein two vibrating components are provided at the frame symmetrically with respect to the longitudinal axis of the racket, each of the vibrating components is connected with the frame at two sites that are spaced apart along the frame, and each of the vibrating components is arranged at an outer side of the frame.

4. The ball game racket according to claim 3, wherein the frame comprises two indentations which are provided symmetrically with respect to the longitudinal axis of the racket and in each of which one of the vibrating components is arranged.

5. A ball game racket comprising a frame having a racket head, a handle portion and a heart portion provided between the racket head and the handle portion and comprising two vibrating components provided symmetrically with respect to the longitudinal axis of the racket, wherein the vibrating components are effective for vibrations having at least two degrees of freedom, and at least one of the vibrating components is arranged at an outer side of the frame.

6. The ball game racket according to claim 1 or 3, wherein each of the vibrating components is arranged in the heart region of the frame.

7. The ball game racket according to claim 1 or 3, wherein each of the vibrating components comprises a mass part that is attached to the frame by at least one spring element.

8. The ball game racket according to claim 7, wherein the mass part is made of metal.

9. The ball game racket according to claim 7, wherein the at least one spring element is made of rubber.

10. The ball game racket according to claim 1, wherein each of the vibrating components and the corresponding indentations are shaped such that an essentially continuous outer circumferential surface is provided.

11. The ball game racket according to claim 1 or 3, wherein each of the vibrating components comprises a first mounting portion, a second mounting portion and a bridging portion connecting the two mounting portions.

12. The ball game racket according to claim 11, wherein a mass part is embedded in the bridging portion.

13. The ball game racket according to claim 11, wherein the mass part forms the bridging portion.

14. The ball game racket according to claim 11, wherein the first and second mounting portions as well as the bridging portion form a spring element.

15. The ball game racket according to claim 11, wherein the first and second mounting portions are formed at the frame in accordance with a curvature of the indentation.

16. The ball game racket according to claim 1 or 3, wherein each of the vibrating components is glued to the frame.

17. The ball game racket according to claim 1 or 3, wherein each of the vibrating components is effective for vibrations having six degrees of freedom.

18. The ball game racket according to claim 1 or 3, wherein each of the vibrating components is effective at vibrations in a direction of the respective degrees of freedom at different frequencies ($f_1$, $f_2$, $f_3$, $f_4$, $f_5$, $f_6$).

19. The ball game racket according to claim 1 or 3, wherein each of the vibrating components has a wide-band damping spectrum.

20. The ball game racket according to claim 1 or 3, wherein each of the vibrating components is adjusted at least in a direction of one degree of freedom to a frequency corresponding substantially to at least 0.8 times to 1.2 times a vibration frequency of the racket ($f_{racket}$).

21. The ball game racket according to claim 20, wherein each of the vibrating components is adjusted at least in the direction of one degree of freedom to a frequency corresponding substantially to the vibration frequency of the racket ($f_{racket}$).

22. The ball game racket according to claim 1 or 3, wherein each of the vibrating components is adjusted at least in a direction of one degree of freedom to a frequency corresponding substantially to at least 1.3 times to 3 times a vibration frequency of the racket ($f_{racket}$).

23. The ball game racket according to claim 22, wherein each of the vibrating components is adjusted at least in the direction of one degree of freedom to a frequency corresponding substantially to two times the vibration frequency of the racket ($f_{racket}$).

24. The ball game racket according to claim 1 or 3, wherein the two vibrating components have different vibration characteristics.

25. A ball game racket comprising a frame forming a head region for receiving a stringing and a handle portion for holding the ball game racket, wherein at the head region the frame comprises in at least two segments one respective inwardly oriented C-profile, wherein the C-profile is at least partially formed such that an inner region of an inner side of the frame is backwardly offset outwardly relative to its normal course towards an outer side of the frame.

26. The ball game racket according to claim 25, wherein the C-profile is essentially formed by two legs and a groove extending therebetween.

27. The ball game racket according to claim 26, wherein the C-profile is at least partially formed in that at an inner side of the frame the legs project inwardly relative to a normal course of the inner side of the frame.

28. The ball game racket according to claim 25, wherein segments are arranged at about 12.30 to 2.30 o'clock and at about 9.30 to 11.30 o'clock.

29. The ball game racket according to claim 25, wherein segments are arranged at about 3.30 to 5.30 o'clock and at about 6.30 to 8.30 o'clock, respectively.

30. The ball game racket according to claim 25, wherein at the two legs of the C-profile, the frame profile is at least 10% wider than at the web of the C-profile, connecting the legs.

31. A ball game racket comprising a frame having a racket head, a handle portion and a heart portion provided between the racket head and the handle portion, wherein the frame comprises two indentations which are provided symmetrically with respect to the longitudinal axis of the racket and in each of which a vibrating component is arranged, each of the vibrating components comprises a first mounting portion, a second mounting portion and a bridging portion connecting the two mounting portions, and a mass part is embedded in the bridging portion.

32. A ball game racket comprising a frame having a racket head, a handle portion and a heart portion provided between the racket head and the handle portion, wherein the frame comprises two indentations which are provided symmetrically with respect to the longitudinal axis of the racket and in each of which a vibrating component is arranged, each of the vibrating components comprises a first mounting portion, a second mounting portion and a bridging portion connecting the two mounting portions, and the first and second mounting portions are formed at the frame in accordance with a curvature of the indentation.

33. A ball game racket comprising a frame having a racket head, a handle portion and a heart portion provided between the racket head and the handle portion, wherein two vibrating components are provided at the frame symmetrically with respect to the longitudinal axis of the racket, each of the vibrating components is connected with the frame at two sites that are spaced apart along the frame, and each of the vibrating components comprises a first mounting portion, a second mounting portion and a bridging portion connecting the two mounting portions, wherein a mass part is embedded in the bridging portion.

34. A ball game racket comprising a frame having a racket head, a handle portion and a heart portion provided between the racket head and the handle portion, wherein two vibrating components are provided at the frame symmetrically with respect to the longitudinal axis of the racket, each of the vibrating components is connected with the frame at two sites that are spaced apart along the frame, and each of the vibrating components comprises a first mounting portion, a second mounting portion and a bridging portion, wherein the first and second mounting portions are formed at the frame in accordance with a curvature of the indentation.

35. A ball game racket comprising a frame having a racket head, a handle portion and a heart portion provided between the racket head and the handle portion and comprising two vibrating components provided symmetrically with respect to the longitudinal axis of the racket, wherein the vibrating components are effective for vibrations having at least two degrees of freedom, at least one of the vibrating components comprises a first mounting portion, a second mounting portion and a bridging portion connecting the two mounting portions, and wherein a mass part is embedded in the bridging portion.

36. A ball game racket comprising a frame having a racket head, a handle portion and a heart portion provided between the racket head and the handle portion and comprising two vibrating components provided symmetrically with respect to the longitudinal axis of the racket, wherein the vibrating components are effective for vibrations having at least two degrees of freedom, at least one of the vibrating components comprises a first mounting portion, a second mounting portion and a bridging portion connecting the two mounting portions, and wherein the first and second mounting portions are formed at the frame in accordance with a curvature of the indentation.

* * * * *